US011639280B2

(12) United States Patent
Nakahata et al.

(10) Patent No.: US 11,639,280 B2
(45) Date of Patent: May 2, 2023

(54) MEDIUM DISCHARGING DEVICE, MEDIUM PROCESSING DEVICE, AND RECORDING SYSTEM

(71) Applicant: SEIKO EPSON CORPORATION, Tokyo (JP)

(72) Inventors: Akinobu Nakahata, Shiojiri (JP); Tsuyoshi Furumido, Shiojiri (JP); Masaki Miyazawa, Matsumoto (JP); Kazuyoshi Ohashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 288 days.

(21) Appl. No.: 16/574,346

(22) Filed: Sep. 18, 2019

(65) Prior Publication Data

US 2020/0087096 A1 Mar. 19, 2020

(30) Foreign Application Priority Data

Sep. 18, 2018 (JP) ..... JP2018-173845

(51) Int. Cl.

| | |
|---|---|
| ***B65H 29/14*** | (2006.01) |
| ***B65H 29/12*** | (2006.01) |
| ***B65H 31/04*** | (2006.01) |
| ***B65H 31/30*** | (2006.01) |

(52) U.S. Cl.

CPC ..... *B65H 29/125* (2013.01); *B65H 29/14* (2013.01); *B65H 31/04* (2013.01); *B65H 31/3027* (2013.01); *B65H 2801/27* (2013.01)

(58) Field of Classification Search

CPC ..... B65H 29/125; B65H 29/14; B65H 31/04; B65H 31/3027; B65H 2801/27; B65H 29/00; B65H 29/26; B65H 29/34; B65H 29/38; B65H 37/04; B42C 1/12; B42C 1/125

See application file for complete search history.

(56) References Cited

U.S. PATENT DOCUMENTS 5,098,074 A * 3/1992 Mandel ..... B42B 4/00 270/58.13
6,142,461 A * 11/2000 Asao ..... B65H 29/14 271/189
7,571,909 B2 * 8/2009 Saeki ..... B65H 31/24 271/292

(Continued)

FOREIGN PATENT DOCUMENTS

JP 2011246283 12/2011
JP 2015107840 6/2015

*Primary Examiner* — Thomas A Morrison
(74) *Attorney, Agent, or Firm* — Workman Nydegger

(57) ABSTRACT

A medium discharging device includes a first tray, a second tray receiving a medium from the first tray, a supporter which is configured to be displaced from a retreat position in the first tray and an advance position above the second tray and which supports the medium, an aligner which is provided in the supporter and that aligns a first end portion which is an upstream end portion in a discharge direction of the medium supported by the supporter, to be displaced together with the supporter, and a restrictor configured to be displaced between a restriction position where an upstream movement of the first end portion of the medium in a position of the aligner in the discharge direction and a non-restriction position where the movement is not restricted, when the supporter is in the advance position.

18 Claims, 24 Drawing Sheets

(56) References Cited

U.S. PATENT DOCUMENTS

| | | | | |
|---|---|---|---|---|
| 7,896,332 | B2 * | 3/2011 | Terao | G03G 15/6532 270/58.11 |
| 8,087,654 | B2 * | 1/2012 | Awano | G03G 15/6541 270/58.11 |
| 2008/0315494 | A1 | 12/2008 | Terao et al. | |
| 2015/0151944 | A1 | 6/2015 | Shirasaki et al. | |

* cited by examiner

MEDIUM DISCHARGING DEVICE, MEDIUM PROCESSING DEVICE, AND RECORDING SYSTEM

The present application is based on, and claims priority from JP Application Serial Number 2018-173845, filed Sep. 18, 2018, the disclosure of which is hereby incorporated by reference herein in its entirety.

BACKGROUND

1. Technical Field

The present disclosure relates to a medium discharging device discharging a medium, a medium processing device including the medium discharging device, and a recording system including the medium discharging device.

2. Related Art

A medium processing device performing processing such as stapling processing and punching processing on a medium includes a medium discharging device that stacks the medium, aligning the end portion thereof, in a first tray, performs processing on the stacked medium, and discharges the post-processing medium to a second tray, for example. Such a medium processing device is incorporated into a recording system configured to continuously execute from recording on a medium in a recording device represented by an ink jet printer to follow-up processing such as stapling processing of the post-recording medium in some cases.

As an example of such a medium processing device, JP-A-2015-107840 discloses a medium processing device configured to perform stapling processing on a plurality of media stacked on a processing tray 28 as a "first tray", and discharges the processed media to a placement tray 31 as a "second tray".

In JP-A-2015-107840, a discharge of post-processing medium in the "first tray" to the "second tray" is performed by a discharge roller 29 which nips and feeds the medium by a roller pair.

If a media bundle in which a plurality of media overlap with one another is discharged by a roller pair, end portions of the media aligned in the "first tray" are disturbed in some cases.

SUMMARY

According to an aspect of the present disclosure, there is provided a medium discharging device including a first tray receiving a medium, a second tray receiving the medium discharged from the first tray, a supporter which is configured to be displaced between a retreat position in the first tray and an advance position above the second tray, ahead of the retreat position in a discharge direction from the first tray to the second tray, and which supports the medium, an aligner which is provided in the supporter and which aligns an upstream end portion in the discharge direction of the medium supported by the supporter, to be displaced together with the supporter, and a restrictor configured to be displaced between a restriction position where an upstream movement of the end portion of the medium in a position of the aligner in the discharge direction is restricted and a non-restriction position where the movement is not restricted, when the supporter is in the advance position.

DESCRIPTION OF EXEMPLARY EMBODIMENTS

Figure 1:
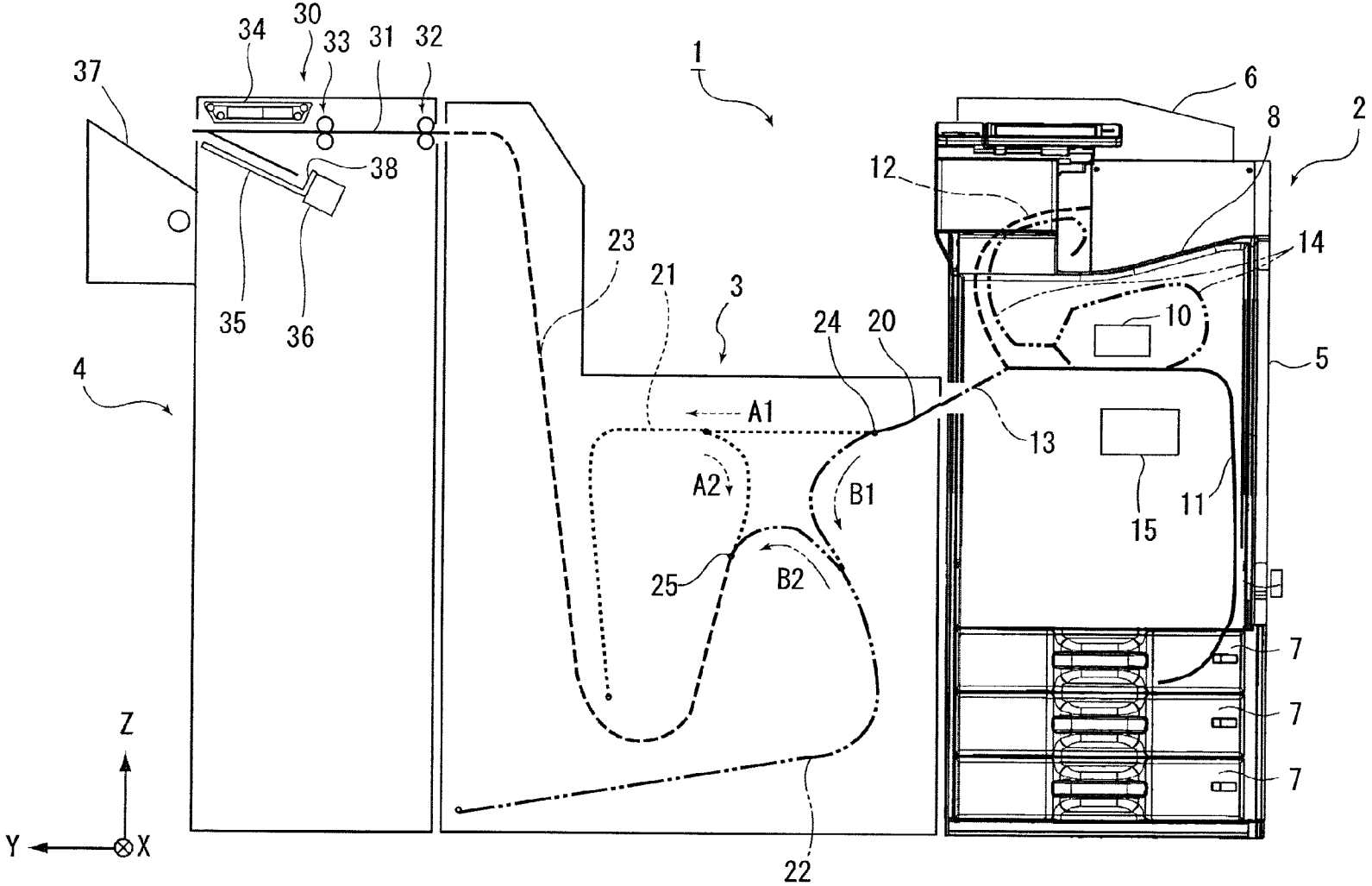
FIG. 1 is a schematic view of a recording system according to a first embodiment.

Hereinafter, the present disclosure will be schematically described.

A medium discharging device according to a first aspect includes a first tray receiving a medium, a second tray receiving the medium discharged from the first tray, a supporter which is configured to be displaced between a retreat position in the first tray and an advance position above the second tray, ahead of the retreat position in a discharge direction from the first tray to the second tray, and which supports the medium, an aligner which is provided in the supporter and which aligns an upstream end portion in the discharge direction of the medium supported by the supporter, to be displaced together with the supporter, and a restrictor configured to be displaced between a restriction position where an upstream movement of the end portion of the medium in the discharge direction is restricted and a non-restriction position where the movement is not restricted, when the supporter is in the advance position.

According to the present embodiment, since a first tray receiving a medium, a second tray receiving the medium discharged from the first tray, a supporter which is configured to be displaced between a retreat position in the first tray and an advance position above the second tray, ahead of the retreat position in a discharge direction from the first tray to the second tray, and which supports the medium, an aligner which is provided in the supporter and which aligns an upstream end portion in the discharge direction of the medium supported by the supporter, to be displaced together with the supporter, and a restrictor configured to be displaced between a restriction position where an upstream movement of the end portion of the medium in the discharge direction is restricted and the non-restriction position where the movement is not restricted, when the supporter is in the advance position, are included, when a plurality of the media are received in the first tray, it is possible to push out and discharge the media to the second tray in a state where the upstream end portions of the media in the discharge direction are aligned. In this way, it is possible to suppress a disturbance of the end portion of the medium.

A specific mechanism discharging the medium from the first tray to the second tray will be described below.

Further, the restrictor is displaced to the restriction position after the aligner is displaced downstream of the restriction position in the discharge direction and is displaced to the non-restriction position after the aligner is displaced to the retreat position.

According to a second aspect, in the first aspect, the supporter is configured to extend along with displacement from the retreat position to the advance position.

According to the present aspect, since the supporter is configured to extend along with the displacement from the retreat position to the advance position, it is possible to advance the supporter to the advance position in which advancement is made from the retreat position in the discharge direction while disposing the supporter compactly in the retreat position.

According to a third aspect, in the second aspect, the supporter includes a first member which is configured to slide with respect to the first tray in the discharge direction and which has a first rack portion and a second rack portion provided in the discharge direction, a second member which is configured to slide with respect to the first member and which has a third rack portion provided in the discharge direction, a third member which is configured to slide with respect to the first member in the discharge direction and which has a fourth rack portion provided to face the second rack portion in a width direction intersecting with the discharge direction, a first gear engaging with the first rack portion, a second gear having a larger number of teeth formed on a rim than the first gear and engaging with the third rack portion to integrally rotate with the first gear, and a pinion gear having a rotation shaft in the second member and engaging with both the second rack portion and the four rack portion.

According to the present aspect, since the supporter includes a first member which is configured to slide in the discharge direction with respect to the first tray and which has a first rack portion and a second rack portion provided in the discharge direction, a second member which is configured to slide in the discharge direction with respect to the first member and which has a third rack portion provided in the discharge direction, a third member which is configured to slide in the discharge direction with respect to the first member and which has a fourth rack portion provided to face the second rack portion in a width direction intersecting with the discharge direction, a first gear engaging with the first rack portion, and a second gear in which a larger number of teeth are formed on a rim than the first gear and which engages with the third rack portion to integrally rotate with the first gear, a speed difference is generated between the first member and the second member moving on a slide. This enables the pinion gear having a rotation shaft in the second member to rotate and the third member to slide to the first member.

Thus, it is possible to secure the extension distance of the supporter in the discharge direction by a compact configuration. A specific configuration of a mechanism extending the supporter will be described in detail below.

According to a fourth aspect, in the third aspect, the aligner is provided upstream of the third member in the discharge direction.

The third member has the longest moving distance in the discharge direction among the first member, the second member, and the third member.

According to the present aspect, since the aligner is provided upstream, in the discharge direction, of the third member having the longest moving distance, it is possible to lengthen an extrusion distance of the medium in the discharge direction.

According to a fifth aspect, in the third aspect of the fourth aspect, the pinion gear is configured to move downstream of the first tray in the discharge direction.

According to the present aspect, since the pinion gear is configured to move downstream of the first tray in the discharge direction, it is possible to securely discharge the medium to the second tray.

According to a sixth aspect, in any one of the first to the fifth aspects, a transport belt, positioned above the first tray and configured to transport the medium by adsorbing the medium on a transport surface and rotating, is included, and the restrictor includes a driven roller transporting the medium together with the transport belt when the restrictor is in the restriction position.

According to the present aspect, since a transport belt, which is positioned above the first tray and which transports the medium by adsorbing the medium on a transport surface and rotating, is included and the restrictor includes a driven roller transporting the medium together with the transport belt when the restrictor is in the restriction position, it is possible for the driven roller to support the transport of the medium by the transport belt when the restrictor is in the restriction position.

According to a seventh aspect, the medium processing device includes the medium discharging device in any one of the first to the sixth aspects and a processor executing predetermined processing on the medium placed in the first tray.

According to the present aspect, an operational effect similar to the effect in the first to the sixth aspects is obtained in the medium processing device including a processor executing predetermined processing on the medium placed in the first tray of the medium discharging device.

According to an eighth aspect, the recording system includes a recording unit including a recorder performing recording on a medium and a processing unit including the medium discharging device, described in any one of claims 1 to 6, discharging the post-recording medium in the recording unit and including a processor executing predetermined processing on the medium placed in the first tray.

According to the present aspect, an operational effect similar to the effect in the first to the sixth aspects is obtained in the recording system that includes a recording unit including a recorder performing recording on a medium and a processing unit including the medium discharging device discharging the post-recording medium in the recording unit and including a processor executing predetermined processing on the medium placed in the first tray.

According to a ninth aspect, in the eighth aspect, an intermediate unit receiving the post-recording medium from the recording unit and delivering the medium to the processing unit is included.

According to the present aspect, an operational effect similar to the effect in the eighth aspect is obtained in the recording system including an intermediate unit receiving the post-recording medium from the recording unit and delivering the medium to the processing unit.

First Embodiment

A first embodiment will be described in the following with reference to drawings. In the X-Y-Z coordinate system shown in each drawing, the X-axis direction is the width direction of a medium and indicates the device depth direction, Y-axis direction is the transport direction of the medium in a medium transport path in the device and indicates the device width direction, and Z-axis direction indicates the device height direction.

Overview of Recording System

A recording system 1 shown in FIG. 1 includes a recording unit 2, an intermediate unit 3, and a processing unit 4, for example, sequentially from right to left of FIG. 1.

The recording unit 2 includes a line head 10 serving as a "recorder" performing recording on a medium. The intermediate unit 3 receives a post-recording medium from the recording unit 2 and delivers the medium to the processing unit 4. The processing unit 4 includes a medium discharging device 30 discharging a post-recording medium in the recording unit 2 and includes a processor 36 executing predetermined processing on the medium placed in a first tray 35 of the medium discharging device 30.

In the recording system 1, the recording unit 2, the intermediate unit 3, and the processing unit 4 are configured to be coupled to each other and a medium is transported from the recording unit 2 to the processing unit 4.

The recording system 1 is configured such that a recording operation to the medium in the recording unit 2, the intermediate unit 3, and the processing unit 4 can be input from an operation panel (not shown). The operation panel can be provided in the recording unit 2, for example.

In the order of the recording unit 2, the intermediate unit 3, and the processing unit 4, the schematic configuration of each will be described.

On Recording Unit

The recording unit 2 shown in FIG. 1 is configured as a multi-function apparatus including a printer unit 5 including a line head 10 (recorder) ejecting ink, which is a liquid, onto a medium to perform recording and a scanner unit 6. In the present embodiment, the printer unit 5 is configured as a so-called ink jet printer.

A plurality of medium storage cassettes 7 are provided in a lower part of the recording unit 2. The medium stored in the medium storage cassette 7 is fed through a transport path 11 denoted by a solid line in the recording unit 2 of FIG. 1 to a recording area in which recording operation is performed by the line head 10. The medium after recording by the line head 10 is fed to either a first discharge path 12 serving as a path for discharging the medium to a post-recording discharge tray 8 provided above the line head 10 or a second discharge path 13 serving as a path for feeding the medium to the intermediate unit 3. The first discharge path 12 is denoted by a broken line and the second discharge path 13 is denoted by a one-dot chain line in the recording unit 2 of FIG. 1.

The recording unit 2 includes a reversing path 14 denoted by a two-dot chain line in the recording unit 2 of FIG. 1 and is configured such that a dual recording, in which the medium is reversed after recording on a first surface of the medium and recording is performed on a second surface, is possible.

As an example of a unit transporting a medium, a transport roller pair or pairs (not shown) are provided in each of the transport path 11, the first discharge path 12, the second discharge path 13, and the reversing path 14.

A controller 15 controlling an operation concerning transport and recording of a medium in the recording unit 2 is provided in the recording unit 2. The controller 15 can be configured to control various operations in the processing unit 4, to be described below, as well as the recording unit 2.

On Intermediate Unit

The intermediate unit 3 shown in FIG. 1 is disposed between the recording unit 2 and the processing unit 4 and is configured to receive the post-recording medium delivered from the second discharge path of the recording unit 2 in the receiving path 20 and transport the medium to the processing unit 4. The receiving path 20 is denoted by a solid line in the intermediate unit 3 shown in FIG. 1.

There are two transport paths in which the medium is transported in the intermediate unit 3. In the first transport path, the medium is transported from the receiving path 20 through a first switchback path 21 to a discharge path 23. In the second path, the medium is transported from the receiving path 20 through a second switchback path 22 to the discharge path 23.

In the first switchback path 21, the medium is received in the arrow A1 direction and then switchbacked in the arrow A2 direction. In the second switchback path 22, the medium received in the arrow B1 direction and then switchbacked in the arrow B2 direction.

The receiving path 20 branches into the first switchback path 21 and the second switchback path 22 at the branching portion 24. Further, the first switchback path 21 and the second switchback path 22 merge at the merging portion 25. Therefore, it is possible to deliver the medium from the common discharge path 23 to the processing unit 4 regardless of which switchback path the medium is delivered in from the receiving path 20.

One or more transport pairs (not shown) are provided in each of the receiving path 20, the first switchback path 21, the second switchback path 22 and the discharge path 23.

When recording is continuously performed on a plurality of media in the recording unit 2, the medium that entered in the intermediate unit 3 is alternately fed to a transport path passing through the first switchback path 21 and a transport path passing through the second switchback path 22. In this way, it is possible to increase the throughput of the medium transport in the intermediate unit 3.

The intermediate unit 3 can also be an omitted recording system. That is, it is possible to configure the processing unit to be directly coupled to the recording unit 2.

Since the transport time is longer when the post-recording medium in the recording unit 2 is fed to the processing unit 4 through the intermediate unit 3 than when the medium is directly fed to the processing unit 4 from the recording unit 2, it is possible to cause the ink of the medium to further dry before the medium is transported to the processing unit 4.

On Processing Unit

The processing unit 4 shown in FIG. 1 includes the medium discharging device 30 discharging the medium received from the intermediate unit 3 and is configured to perform processing, in the processor 36, on the medium discharged to the first tray 35 of the medium discharging device 30. An example of processing performed in the processor 36 includes stapling processing and a punching processing. In the present embodiment, the medium discharging device 30 discharges the medium which is received from the discharge path 23 of the intermediate unit 3 and is transported through the transport path 31.

The processing unit 4 includes a first transport roller pair 32 and a second transport roller pair 33 transporting the medium in a first transport direction and transports the medium toward the medium discharging device 30. In the present embodiment, since the first transport direction is substantially in the +Y direction, the first transport direction is hereinafter referred to as a first transport direction +Y.

A transporter 34 is provided downstream of the second roller pair 33 in the first transport direction +Y. The transporter 34 transports the medium by a transport belt 40 to be described below. The transporter 34 is configured to transport a medium in the first transport direction +Y and the second transport direction opposite to the first transport direction +Y. In the following, the second transport direction will be referred to as a second transport direction −Y.

On Medium Discharging Device

Figure 3:
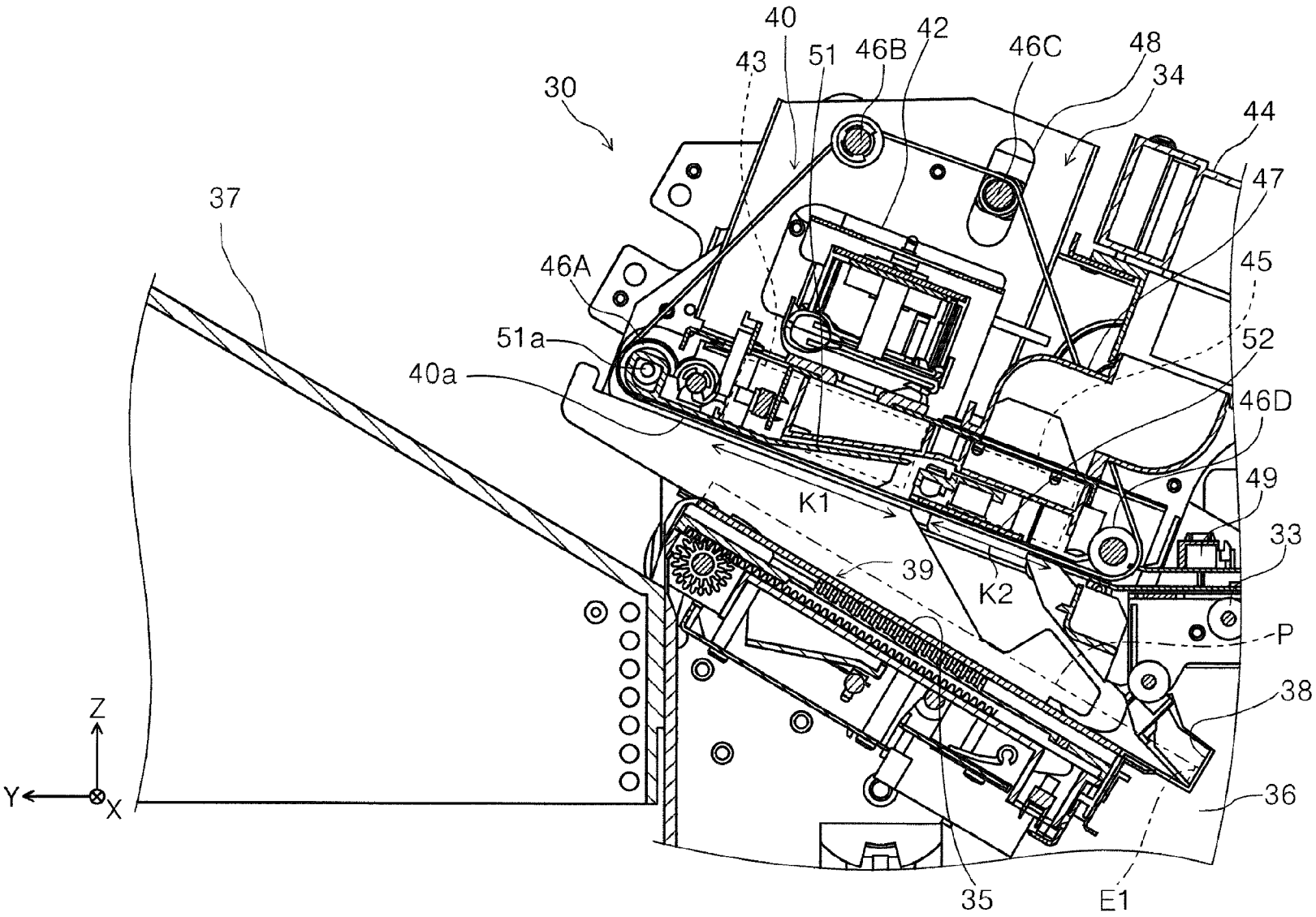
FIG. 3 is a side sectional view showing the medium discharging device according to the first embodiment.

As shown in FIG. 3, the medium discharging device 30 includes a first tray 35 receiving a medium and a second tray 37 receiving the medium discharged from the first tray 35. A supporter 39, to be described below, is provided in the first tray 35.

A medium P transported by the transporter 34 is placed in the first tray 35. A first end portion E1, which is an upstream end portion in the +Y direction, which is the discharge direction of the medium P, contacts with the aligner 38 and the position thereof is straightened in the first tray 35. When a plurality of sheets of medium P are placed in the first tray 35, the first end portion E1 is aligned by the aligner 38.

Figure 12:
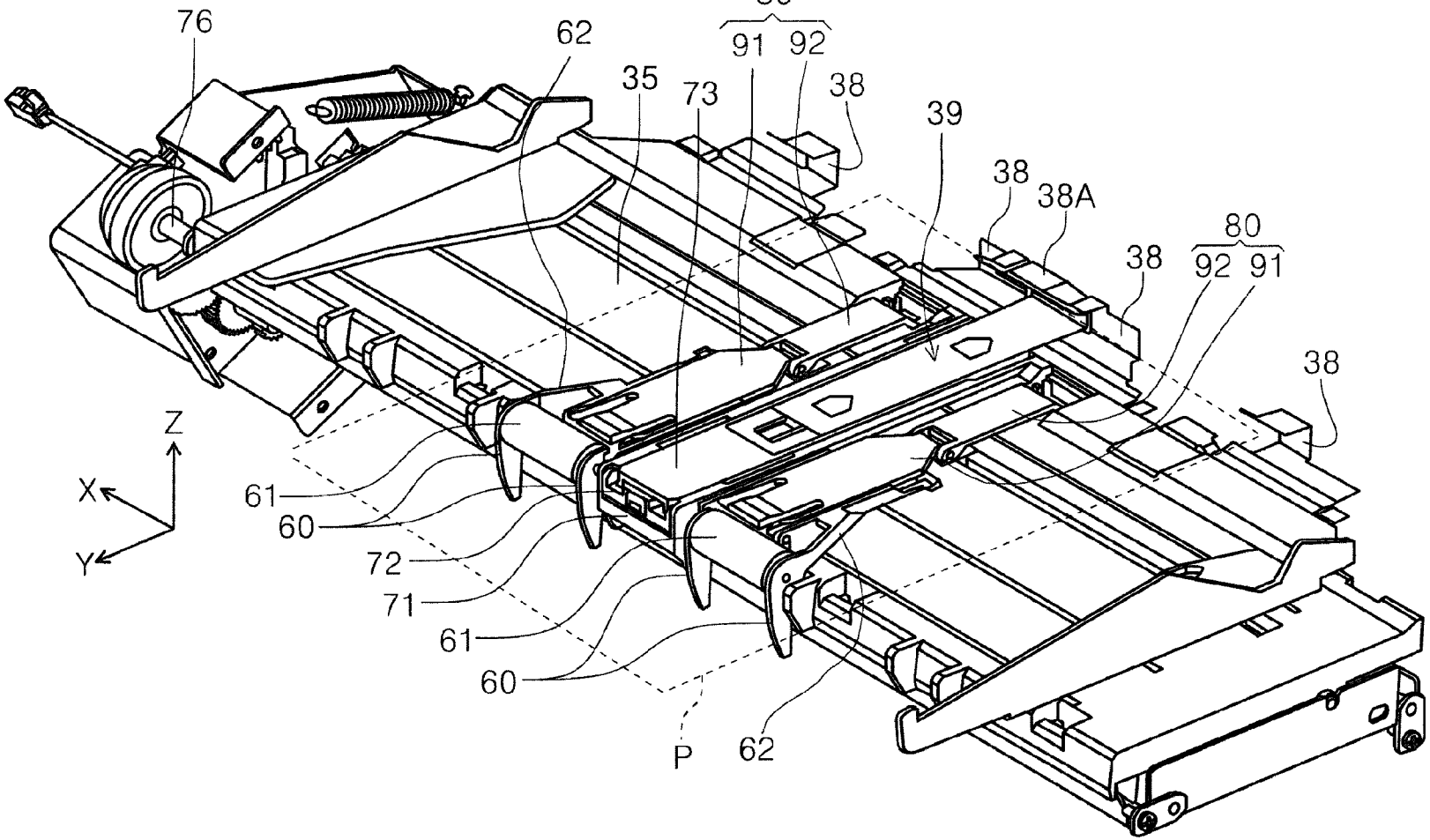
FIG. 12 is a perspective view showing a state of the supporter and the restrictor corresponding to FIG. 8.

As shown in FIG. 12 as an example, a plurality of the aligners 38 are provided in the X-axis direction which is the width direction and one of them, the aligner 38A, is provided in the supporter 39.

In the medium discharging device 30 shown in FIG. 3, the first end portion E1 is straightened by the aligner 38 and a processing such as a stapling processing or the like is performed on one sheet, or a plurality of sheets, of the medium P placed in the first tray 35 by the processor 36 provided in a vicinity of the aligner 38. The medium P after processing by the processor 36 is discharged to the second tray 37 from the first tray 35. The second tray 37 receives the medium P after processing by the processor 36 upstream of the first suction area K1 in the second transport direction −Y.

The first tray 35 is provided below the transport belt 40 constituting the transporter 34, and the medium P, transported in the second transport direction −Y after being transported in the first transport direction +Y by the transport belt 40, is placed in the first tray 35.

In the following, a method of discharging the medium placed in the first tray 35 to the second tray 37 will be briefly described, and then, the above supporter 39 will be described. The transport of the medium to the first tray 35 by the transport belt 40 will be described after the supporter 39 is described.

On Discharge of Medium from the First Tray to the Second Tray

Discharge of the medium P from the first tray 35 to the second tray 37 will be described with reference to FIGS. 8 to 15. FIGS. 12 to 15 are perspective views showing states of the supporter and the controller, corresponding to FIGS. 8 to 11.

Figure 8:
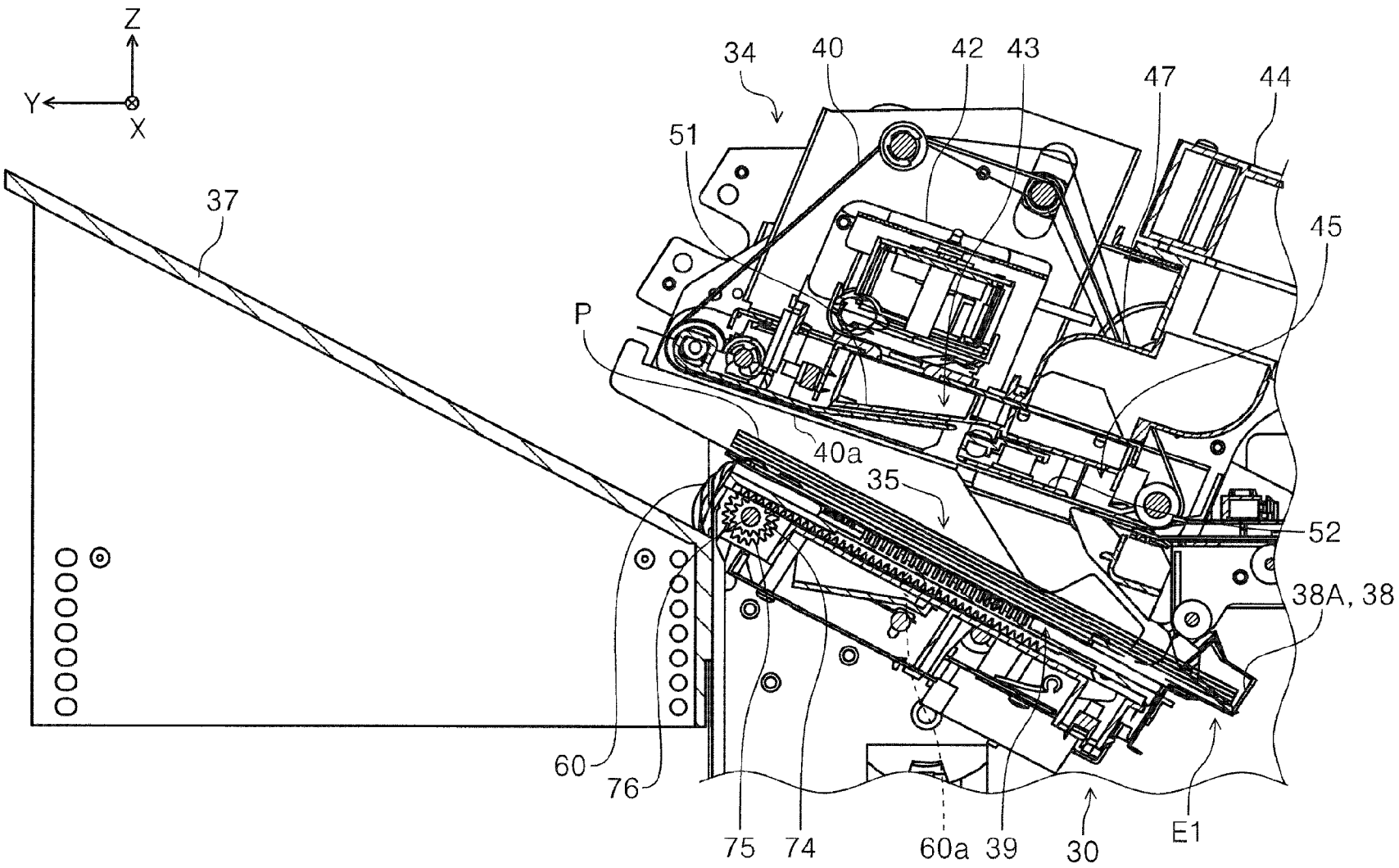
FIG. 8 is a side sectional view showing a state where a supporter is in a retreat position, a restrictor is in a non-restriction position, and a medium bundle is placed in a first tray in the medium discharging device.

FIGS. 8 and 12 show states in which the medium P is placed in the first tray 35.

Figure 9:
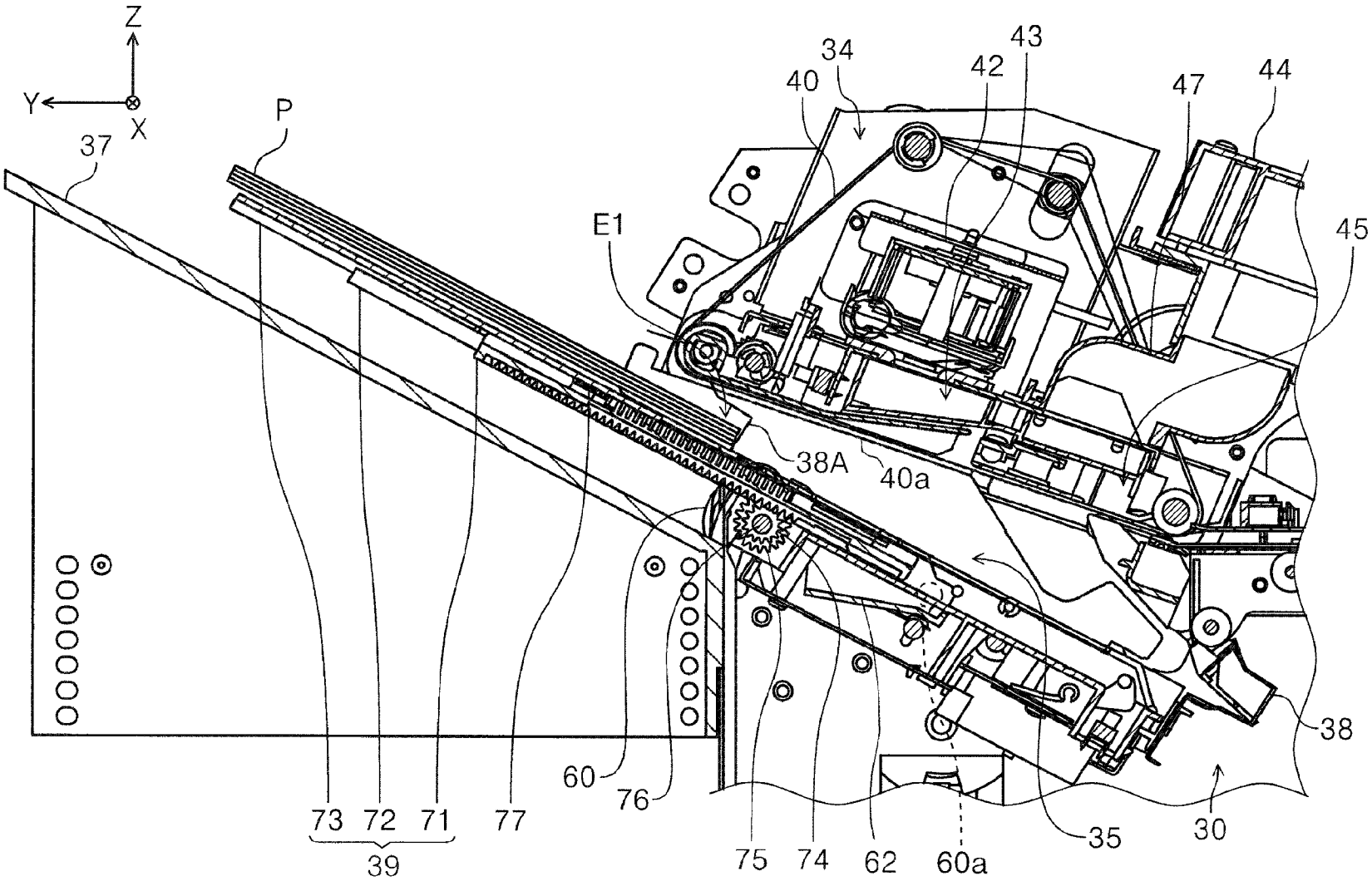
FIG. 9 is a side sectional view showing a state where the supporter supports a medium and is in an advance position and the restrictor is in a non-restriction position in the medium discharging device.
Figure 13:
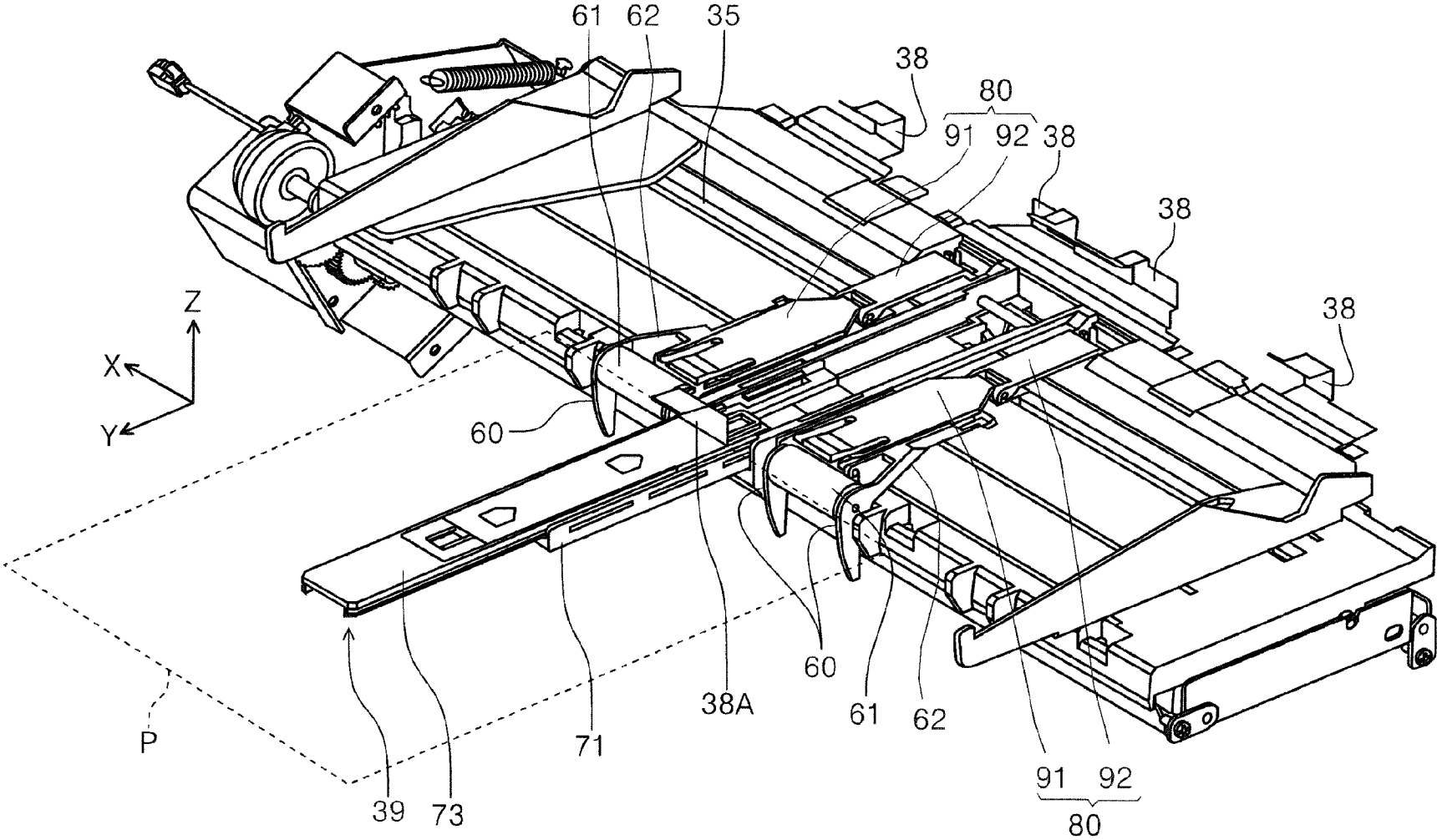
FIG. 13 is a perspective view showing a state of the supporter and the restrictor corresponding to FIG. 9.

The supporter 39 provided in the first tray 35 is configured to be displaced between the retreat position in the first tray 35 as shown in FIGS. 8 and 12 and the advance position above the second tray 37, ahead of the retreat position in the +Y direction which is the discharge direction from the first tray 35 to the second tray 37, as shown in FIGS. 9 and 13. The supporter 39 can support the medium P in both the retreat position and the advance position. The supporter 39 is provided with the aligner 38A and moves following the displacement of the supporter 39.

When the medium P is placed in the first tray 35 by the transport belt 40, the supporter 39 is disposed in the retreat position shown in FIGS. 8 and 12. The supporter 39 supports the medium P together with the place surface of the first tray 35 and performs processing on the medium P by the processor 36 in this state in FIGS. 8 and 12.

When the processing by the processor 36 is performed on the medium P placed on the first tray 35, the medium P is discharged from the first tray 35 to the second tray 37.

When the medium P is discharged from the first tray 35 to the second tray 37, the supporter 39 moves from the retreat position shown in FIGS. 8 and 12 to the advance position shown in FIGS. 9 and 13. Since the aligner 38A is provided in the supporter 39 and moves together with the supporter 39, the supporter 39 moves to the advance position while supporting the medium P.

Here, the medium discharging device 30 includes a restrictor configured to be displaced, in the +Y direction which is the discharge direction, between the restriction position (FIG. 10) where an upstream movement of the first end portion E1 of the medium P in the position of the aligner 38A moving together with the supporter 39 is restricted and the non-restriction position (FIG. 9) where the movement is not restricted, when the supporter 39 is in the advance position.

Figure 10:
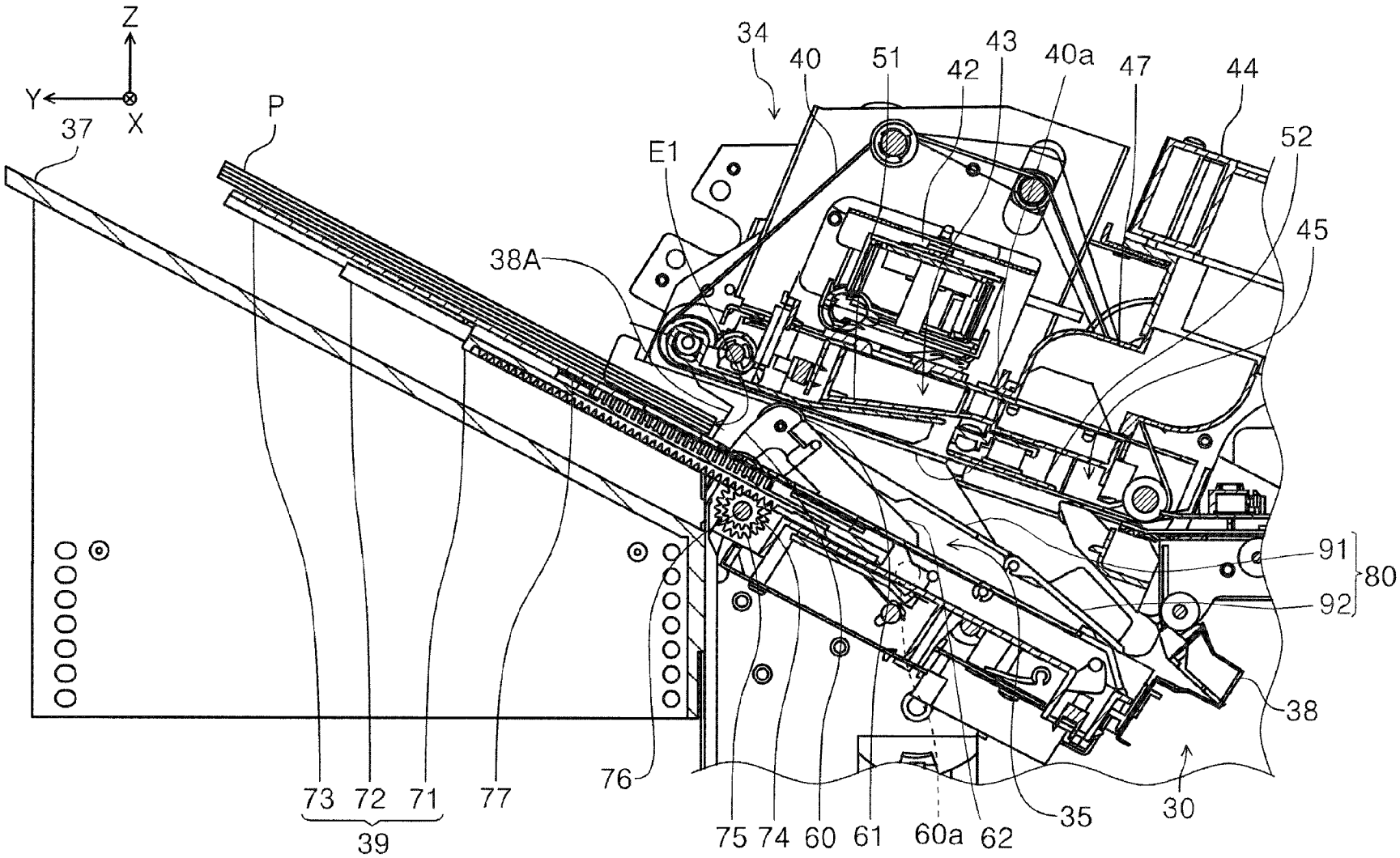
FIG. 10 is a side sectional view showing a state where the supporter is in the advance position supporting a medium and the restrictor is in a restriction position.
Figure 14:
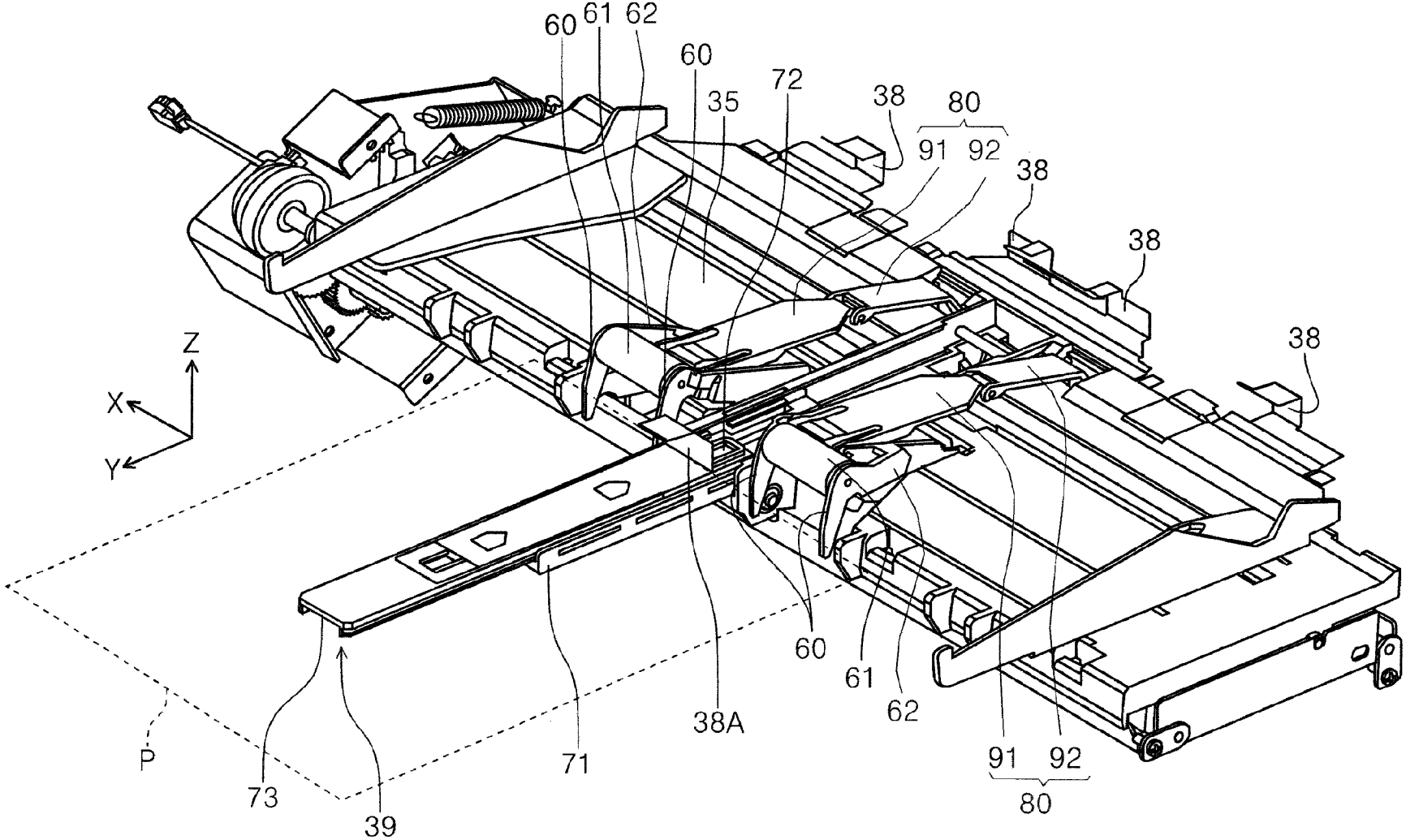
FIG. 14 is a perspective view showing a state of the supporter and the restrictor corresponding to FIG. 10.

The restrictor 60 protrudes from the placement surface of the first tray 35 in the restriction position as shown in FIGS. 10 and 14 and retreats to the first tray 35 side in the non-restriction position as compared with the restriction position as shown in FIGS. 9 and 13.

In the present embodiment, the restrictor 60 is provided in the base portion 62 swinging about a pivot shaft 60*a* shown in FIGS. 9 and 10 and is configured to swing between the restriction position (FIG. 10) and non-restricting position (FIG. 9). The base portion 62 including the restrictor 60 swings by the power of a driving source (not shown).

As shown in FIGS. 12 to 15, the restrictor 60 is disposed in a position deviating from the supporter 39 in the X-axis direction which is the width direction. More specifically, the restrictor 60 is provided on both sides of the supporter 39 in the width direction.

When the supporter 39 moves to the advance position shown in FIGS. 9 and 13, the restrictor 60 is displaced to the restriction position as shown in FIGS. 10 and 14.

Figure 11:
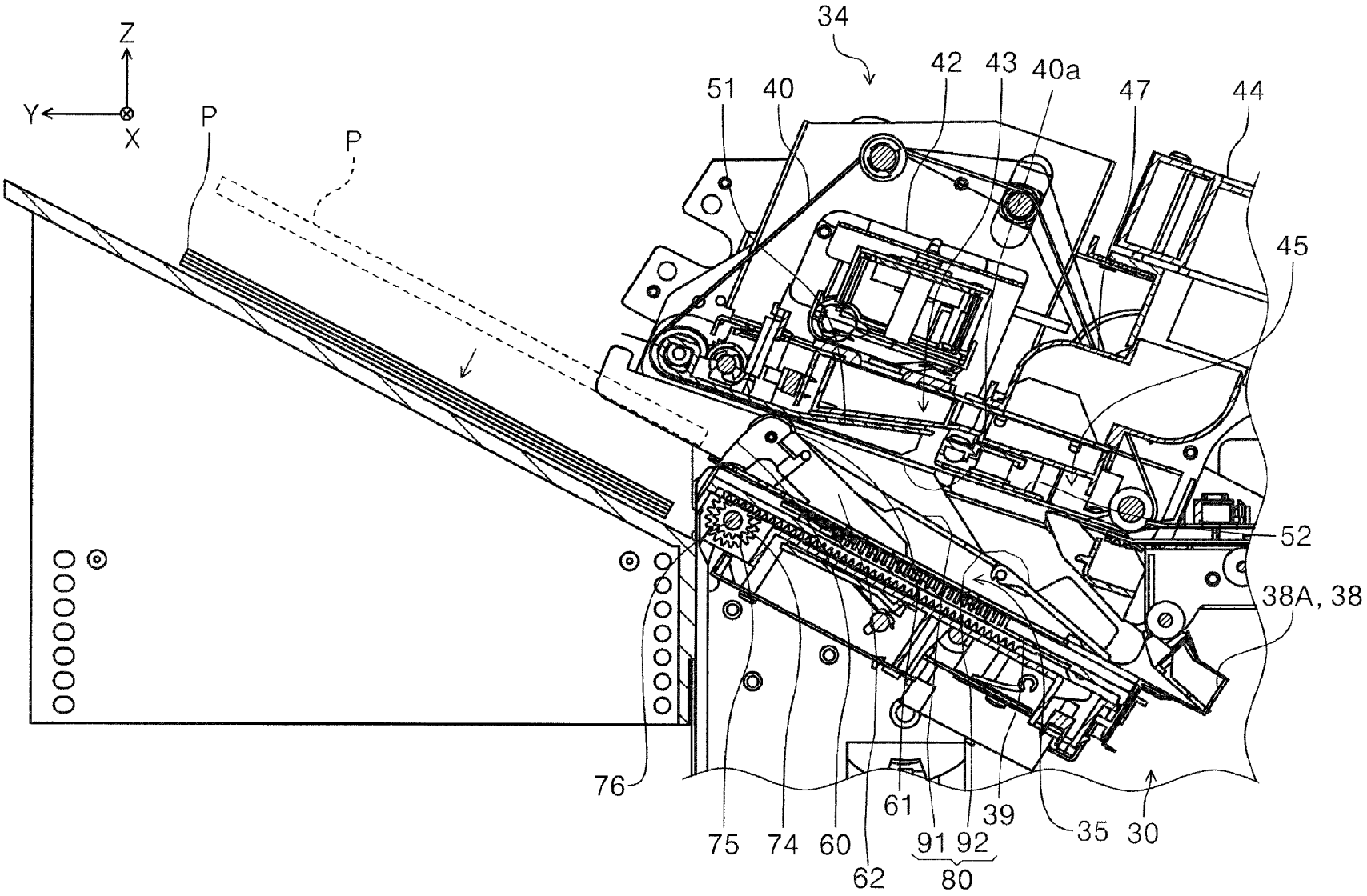
FIG. 11 is a side sectional view showing a state where the supporter is in a retreat position, the restrictor is in the restriction position, and a medium bundle is placed in a second tray.
Figure 15:
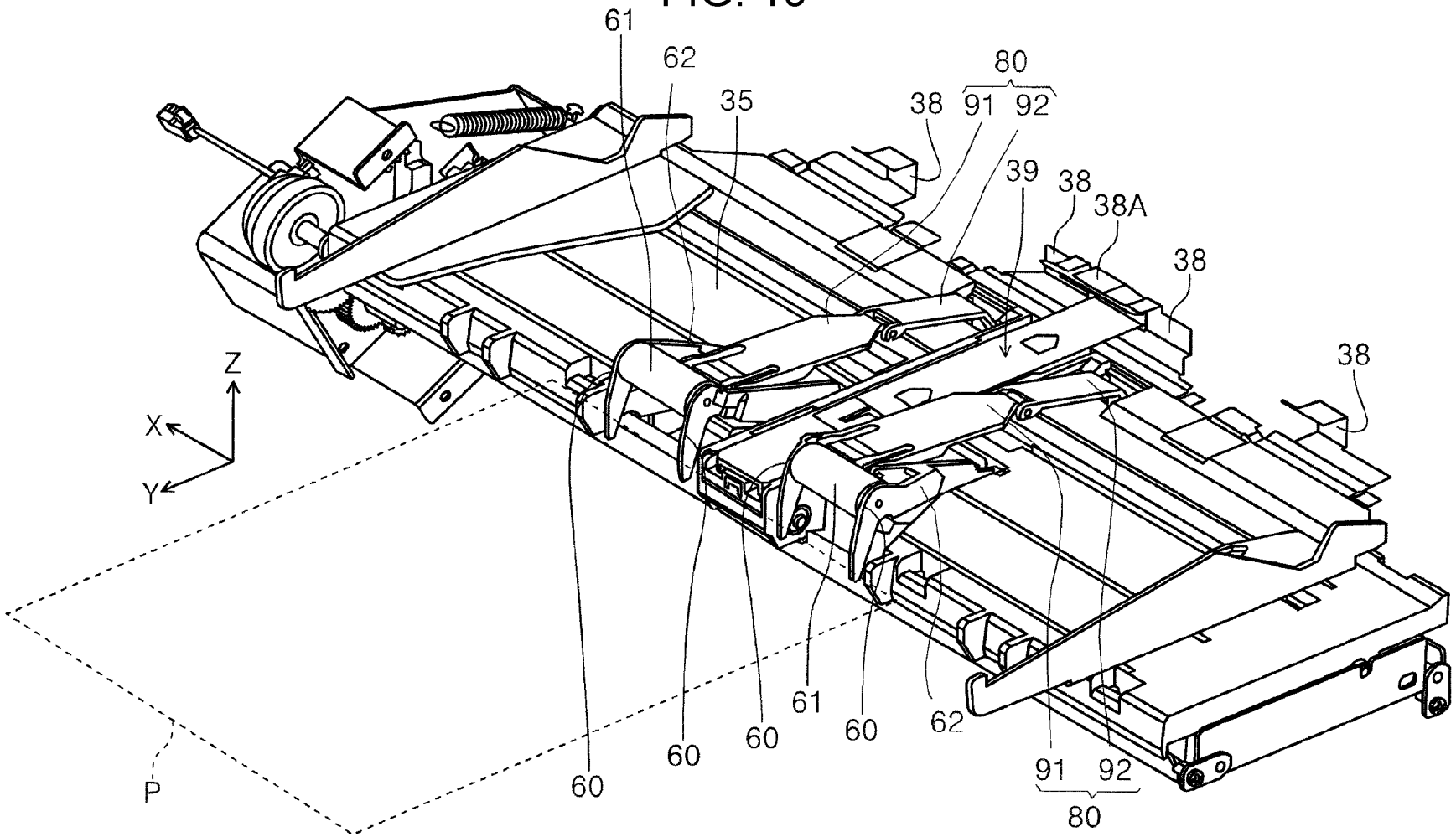
FIG. 15 is a perspective view showing a state of the supporter and the restrictor corresponding to FIG. 11.

Then, as the supporter 39 returns to the retreat position as shown in FIGS. 11 and 15 in a state where the movement of the medium P in the −Y direction is restricted by the restrictor 60 in the restriction position, the medium P not supported by the supporter 39 falls onto the second tray 37 as shown in FIG. 11. In this way, the medium P is discharged from the first tray 35 to the second tray 37 such that, when a plurality of media P are placed in the first tray 35, it is possible to push out and discharge the medium P to the second tray 37 while maintaining the alignment of the first end portion E1 of the medium P aligned by the aligner 38.

Next, the configuration of the supporter 39 will be described mainly with reference to FIGS. 16 to 21.

In the medium discharging device 30, the supporter 39 is configured to extend along with the displacement from the retreat position shown in FIG. 8 to the advance position shown in FIG. 9. Since the supporter 39 is configured to extend along with the displacement from the retreat position to the advance position, it is possible to secure distance of the supporter 39 from the retreat position to the advance position of the supporter 39 while compactly disposing the supporter 39 in the retreat position in the first tray 35.

In the present embodiment, the configuration of the supporter 39 extending along with the displacement from the retreat position to the advance position is as follows.

Figure 16:
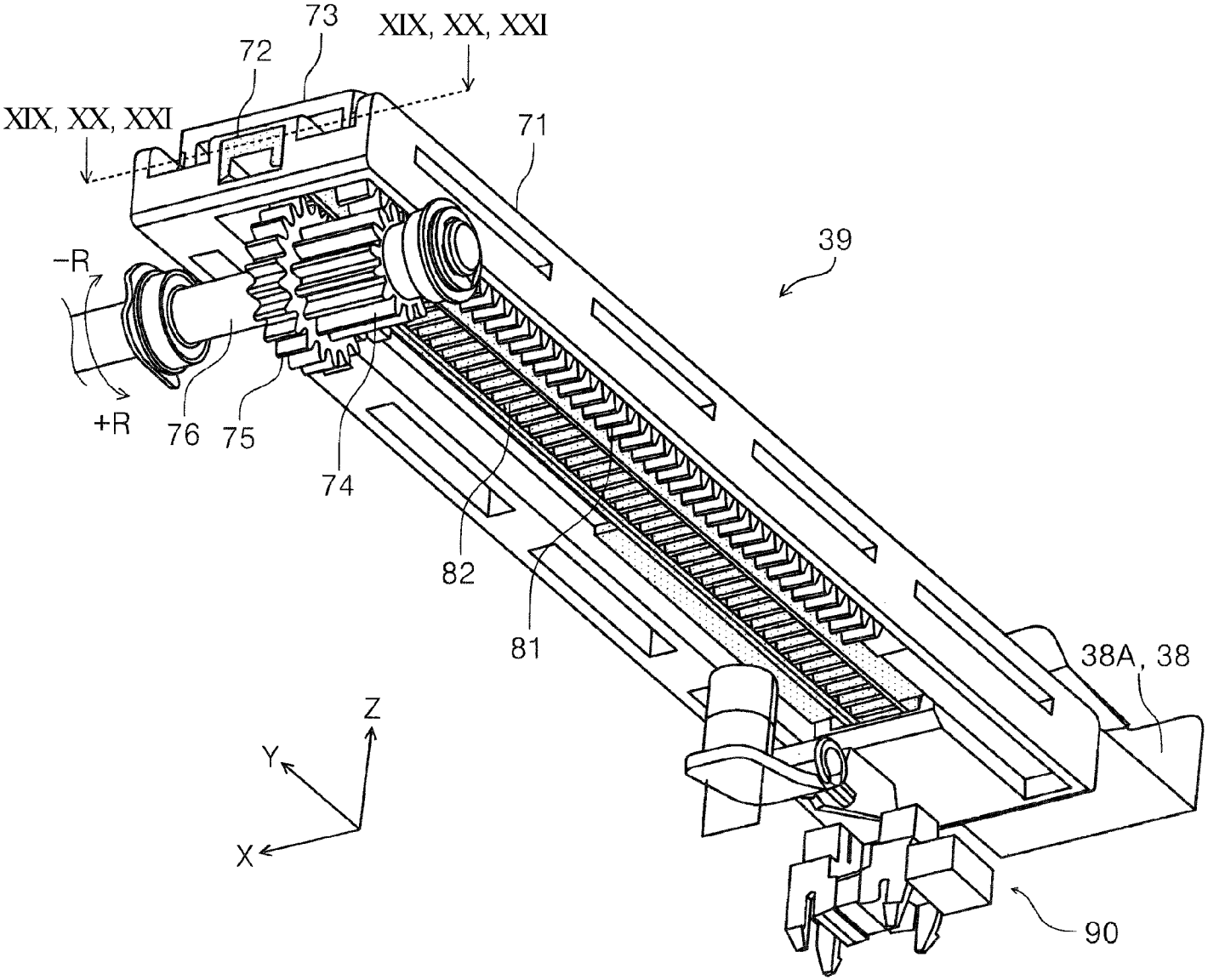
FIG. 16 is a perspective view of the supporter in the retreat position as viewed from below.
Figure 17:
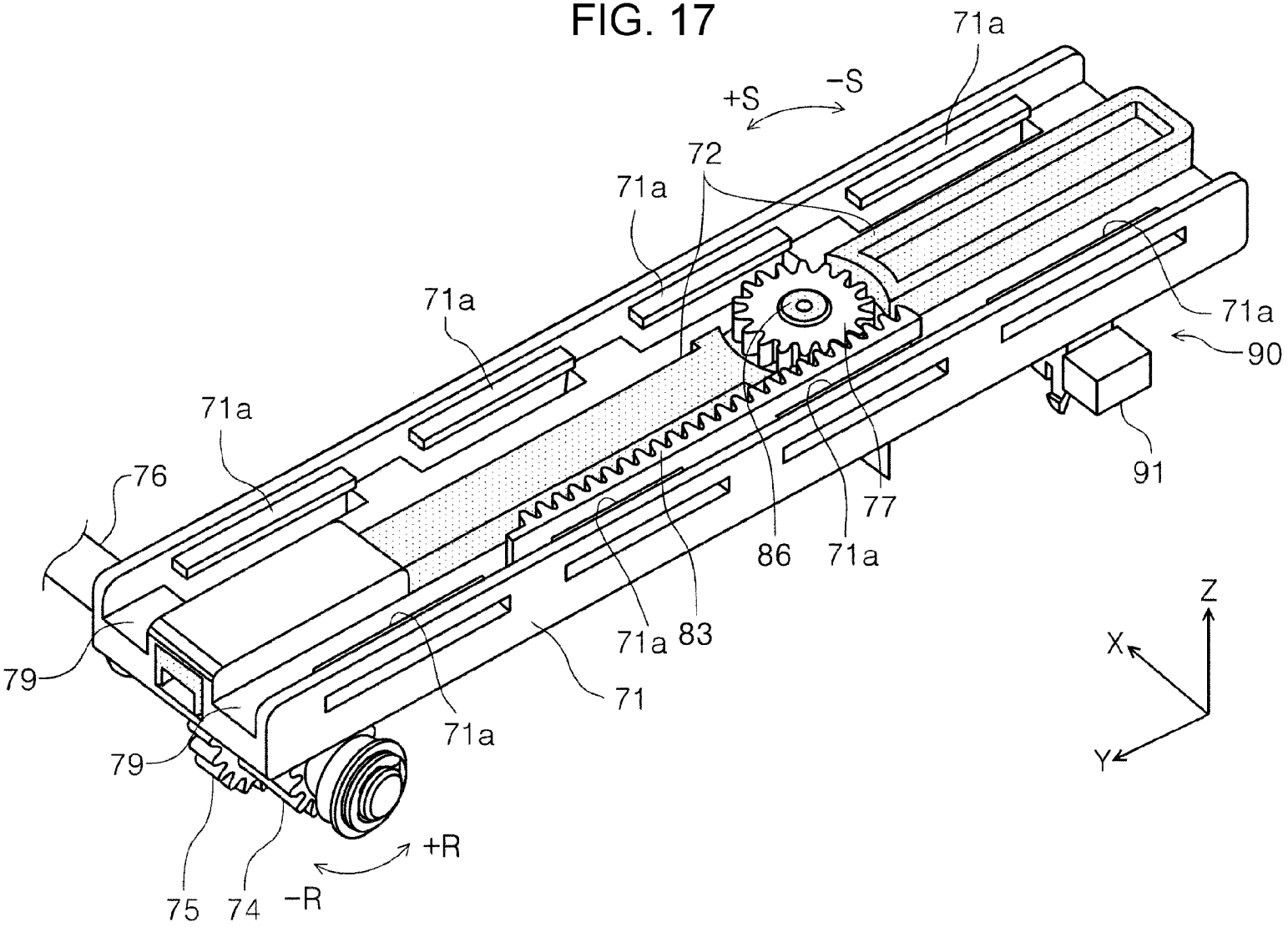
FIG. 17 is a perspective view showing a state where a third member is removed from the supporter.

The supporter 39 shown in FIG. 16 includes a first member 71, a second member 72, a third member 73, a first gear 74, a second gear 75, and a pinion gear 77 (FIG. 17).

Figure 19:
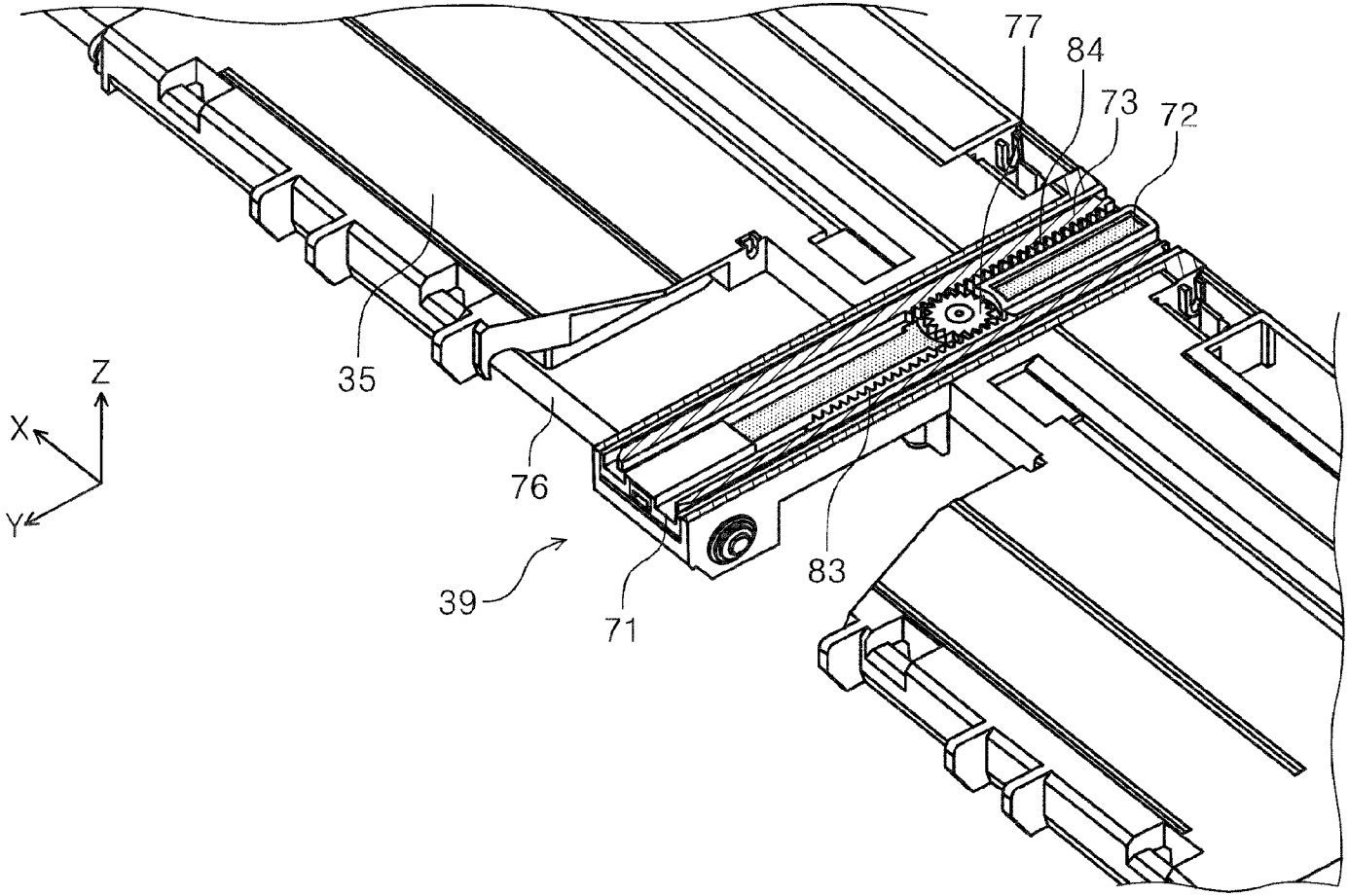
FIG. 19 is a view of the supporter in the retreat position, corresponding to a sectional view taken along line IXX-IXX of the supporter shown in FIG. 16.
Figure 20:
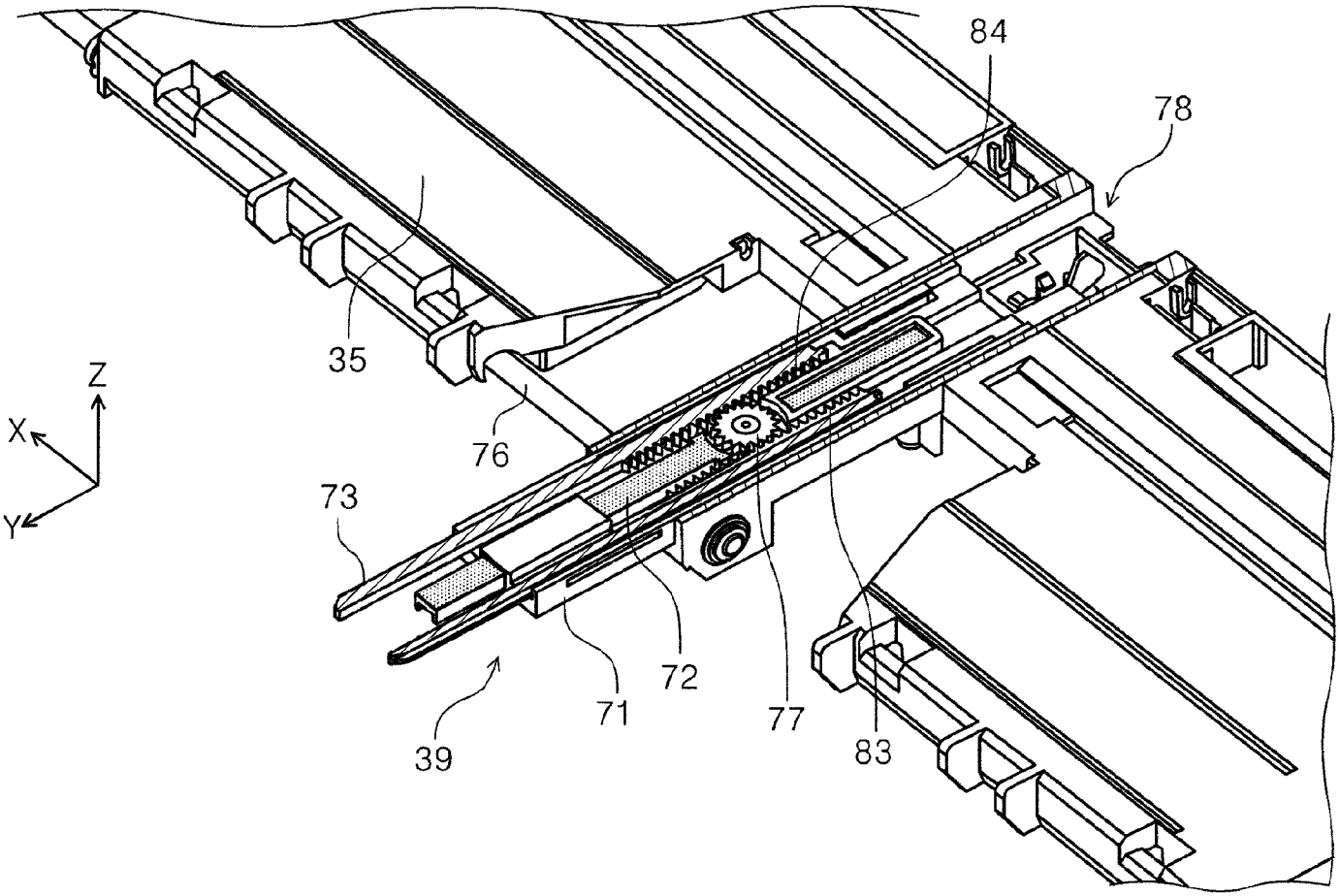
FIG. 20 is a view of the supporter between the retreat position and the advance position, corresponding to a sectional view taken along line IXX-IXX of the supporter shown in FIG. 16.
Figure 21:
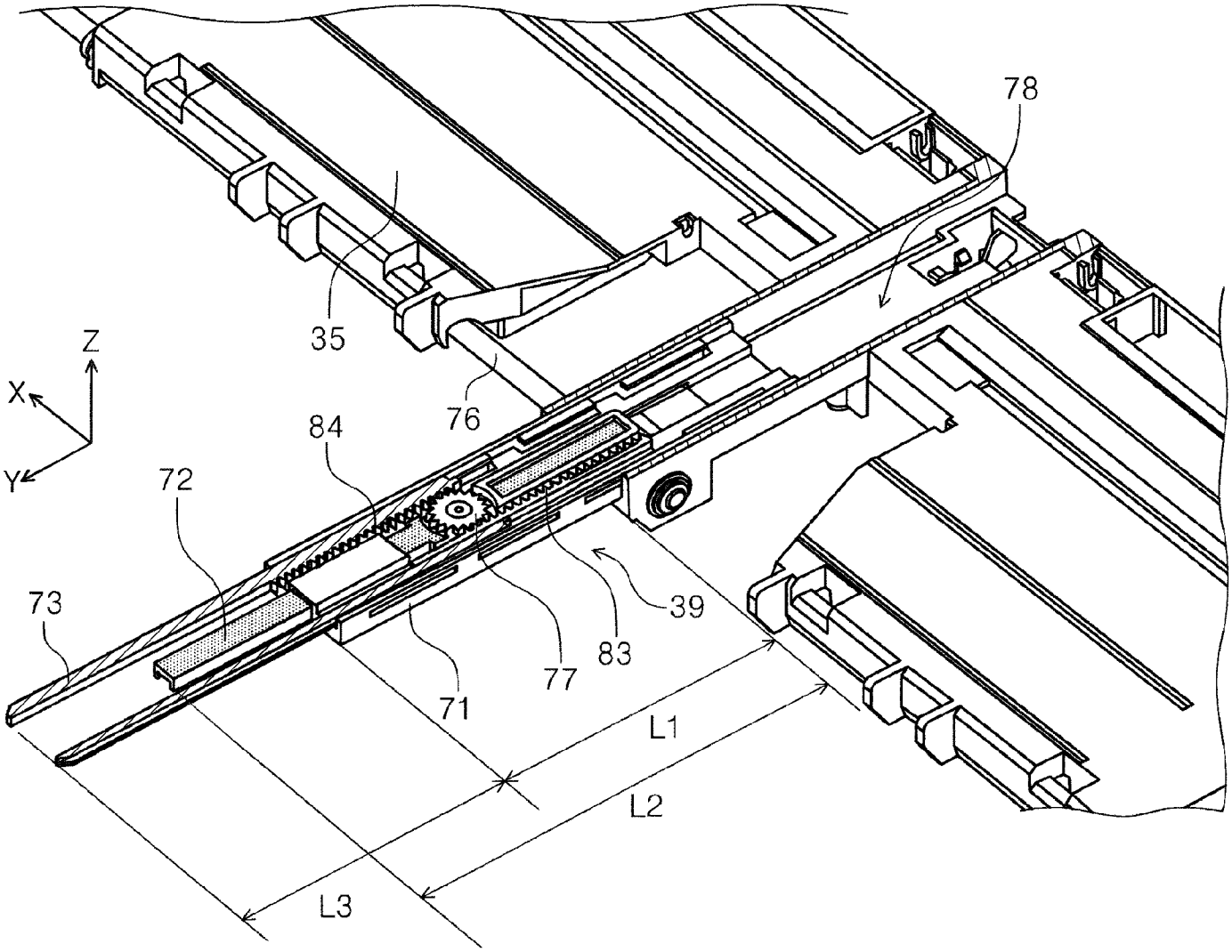
FIG. 21 is a view of the supporter in the advance position, corresponding to a sectional view taken along line IXX-IXX of the supporter shown in FIG. 16.

As shown in FIGS. 19 to 21, the first member 71 is configured to slide with respect to the first tray 35 in the discharge direction in the Y-axis direction and has a first rack portion 81 (FIG. 16) and a second rack portion 83 (FIG. 17) provided in the Y-axis direction. As shown in FIGS. 20 and 21, the first member 71 is configured to slide with respect to the groove portion 78 extending in the Y-axis direction in the first tray 35.

In the supporter 39 shown in FIG. 16, the second member 72 is configured to slide with respect to the first member 71 in the Y-axis direction and has a third rack portion 82 provided in the Y-axis direction.

Figure 18:
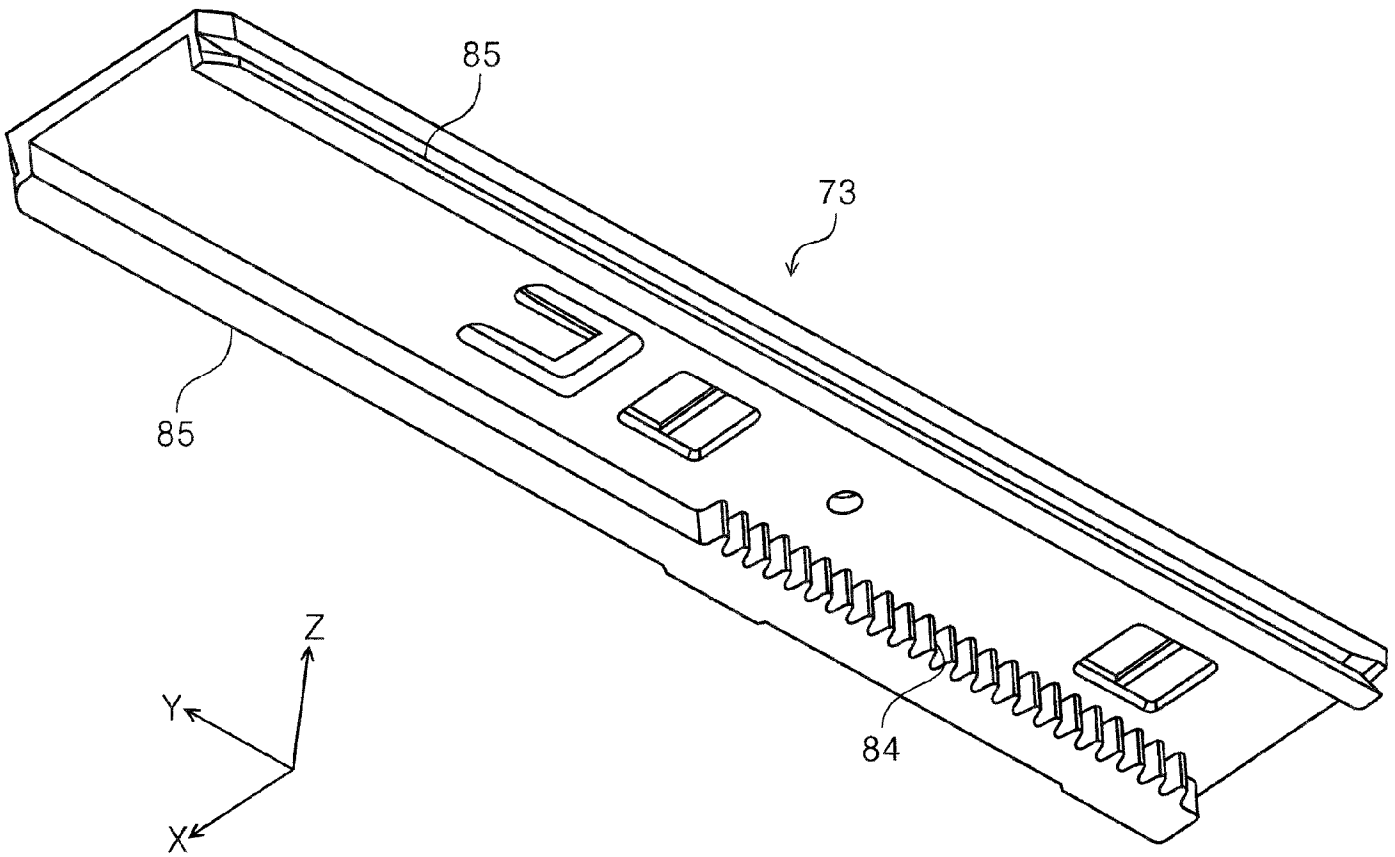
FIG. 18 is a perspective view of the third member as viewed from below.

The third member 73 is configured to slide with respect to the first member 71 in the discharge direction in the Y-axis direction and has a fourth rack portion 84 as shown in FIG. 18. The third member 73 shown in FIG. 18 has a guide portion 85 on both sides in the width direction, the guide portion 85 is guided by a protruding portion 71*a* in the groove portion 79 of the first member 71 shown in FIG. 17, and the third member 73 slides with respect to the first member 71. As shown in FIGS. 19 to 21, the fourth rack portion 84 is provided to face the second rack portion 83 of the first member 71 in the X-axis direction which is the width direction intersecting with the discharge direction. The aligner 38A provided in the supporter 39 is provided in the third member.

Further, in the supporter 39 shown in FIG. 16, the first gear 74 engages with the first rack portion 81. The second gear 75 has a larger number of teeth formed on a rim than the first gear 74 and engages with the third rack portion 82 to integrally rotate with the first gear 74. The first gear 74 and the second gear 75 are provided on the same rotation shaft 76. The first gear 74 and the second gear 75 are rotated by the rotation shaft 76 rotated by the force of a driving source (not shown). The first gear 74 and the second gear 75 are configured to rotate in both the +R direction and the −R direction denoted by a double arrow in FIG. 16.

FIG. 16 shows a state where the supporter 39 is in the retreat position, and, as shown in FIG. 8, the first gear 74 and the second gear 75 are provided in the end portion of the first tray 35 in the +Y direction.

The pinion gear 77 shown in FIG. 17 has a rotation shaft 86 in the second member 72 and engages with both the second rack portion 83 and the fourth rack portion 84 as shown in FIGS. 19 to 21.

If the first gear 74 and the second gear 75 shown in FIG. 16 are rotated in the +R direction from a state where the supporter 39 is in the retreat position, the supporter 39 starts to move toward the advance position in the +Y direction.

More specifically, if the first gear 74 and the second gear 75 are rotated in the +R direction, the first member 71 having the first rack portion 81 engaging with the first gear 74 and the second member 72 having the third rack portion 82 engaging with the second gear 75 move in the +Y direction respectively.

Since the second gear 75 has a larger number of teeth formed on the rim than the first gear 74, the moving speed of the second member 72 is higher than the moving speed of the first member 71. That is, a speed difference is generated between the moving first member 71 and second member 72.

If a speed difference is generated between the first member 71 and the second member 72, the pinion gear 77 having the rotation shaft 86 (FIG. 17) in the second member 72 rotates. In this way, it is possible to slide the third member 73 with respect to the first member 71.

In FIG. 17, if the first gear 74 and the second gear 75 are rotated in the +R direction, the pinion gear 77 rotates in the +S direction and the third member 73 (FIG. 15) moves in the +Y direction.

In the present embodiment, FIG. 21 shows the moving distance of each of the first member 71, the second member 72, and the third member 73 when the supporter 39 moves from the retreat position shown in FIG. 19 to the advance position shown in FIG. 21. When the moving distance of the first member 71 is defined as a distance L1, the moving distance of the second member 72 having a higher moving speed is a distance L2 longer than the distance L1. Further, when the moving distance of the third member 73 with respect to the first member 71 is defined as a distance L3, the total moving distance of the third member 73 becomes a distance (L1+L3), and the third member 73 ends up moving the longest distance among the first member 71, the second member 72, and the third member 73.

The aligner 38A shown in FIG. 16 is provided upstream of the third member 73 in the discharge direction as described above. Since the aligner 38A is provided in the third member 73 having the longest moving distance among the first member 71, the second member 72, and the third member 73 constituting the supporter 39, it is possible to lengthen the extrusion distance of the medium in the discharge direction.

The supporter 39 is moved from the advance position shown in FIG. 21 to the retreat position shown in FIG. 19 by the rotation of the first gear 74 and the second gear 75 shown in FIG. 17 in the −R direction.

Further, in the present embodiment, as shown in FIG. 9, the pinion gear 77 is configured to move downstream of the first tray 35 in the +Y direction which is the discharge direction. In this way, it is possible to discharge the medium P to the second tray 37 more securely.

It is possible to detect the position of the supporter 39 by a supporter detector 90 shown in FIG. 16. The supporter detector 90 is provided on the first tray 35 side and is configured with a transmission-type optical sensor, for example.

Other Configurations of Restrictor

In the present embodiment, the restrictor 60 includes a driven roller 61 transporting the medium P together with the transport belt 40 when the restrictor 60 is in the restriction position shown in FIGS. 11 and 15.

Figure 22:
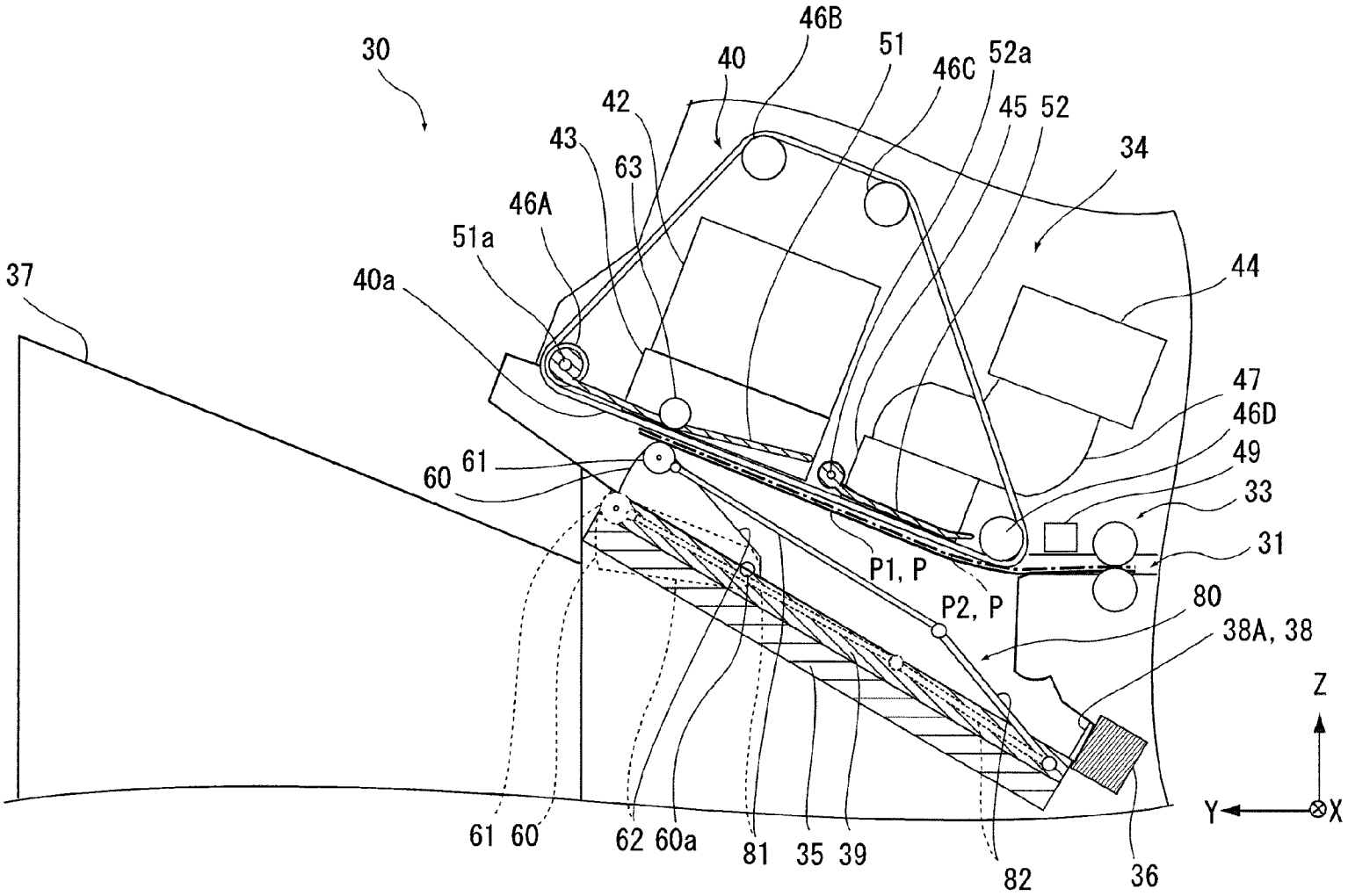
FIG. 22 is a schematic view describing a transport position and the retreat position of a driving roller.

Here, in the processing unit 4, in order to improve the throughput when a plurality of sheets of medium are stacked in the first tray 35, as shown in FIG. 22, in some cases overlapping transport processing is performed, in which a preceding medium P1 transported first and the succeeding medium P2 transported next to the preceding medium overlap with each other and then are transported to the first tray 35. The overlapping transport processing may be called buffer processing.

If two sheets of the preceding medium P1 and the succeeding medium P2 are adsorbed onto the transport belt 40, the preceding medium P1 positioned on a lower side in FIG. 22 does not directly contact with the transport surface 40*a*, and thus, is not adsorbed. When the preceding medium P1 and the succeeding medium P2 are different in size or the preceding medium P1 and the succeeding medium P2 slightly deviate from each other even if the size is the same, the preceding medium P1 may be adsorbed a little, but adsorption force is insufficient. Therefore, the preceding medium P1 may not be appropriately transported to the first tray 35 by the transport belt 40.

As shown in FIG. 22, since the restrictor 60 includes a driven roller 61 transporting the medium P together with the transport belt 40 when in the restriction position denoted by a solid line in FIG. 22, it is possible to position the restrictor 60 in the restriction position and transport the preceding medium P1 and the succeeding medium P2 nipped between the transport belt 40 and the driven roller 61 when the preceding medium P1 and the succeeding medium P2 are transported by the transport belt 40, overlap with each other. That is, it is possible to support the transport of the medium P by the transport belt 40 with the driven roller 61.

In FIG. 22, the succeeding medium P2 is superimposed on the preceding medium P1, but it can be reversed, of course.

On Driven Roller

Figure 23:
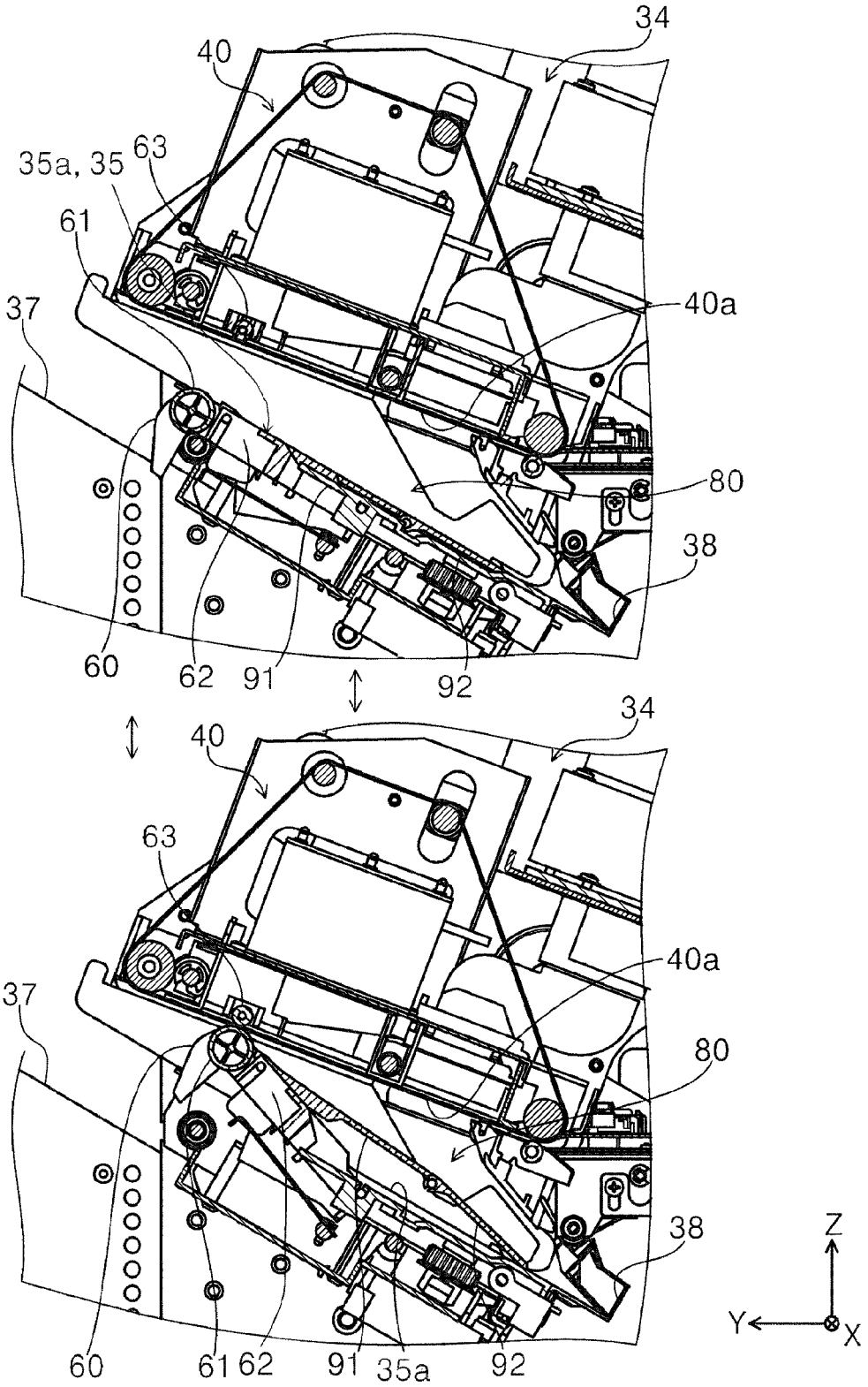
FIG. 23 is a side sectional view describing the transport position and the retreat position of the driven roller and a first state and a second state of a guider.

Focusing on the driven roller 61, the driven roller 61 is configured to move between the transport position where the medium P can be nipped between the transport belt 40 and the driven roller 61 as shown in an upper diagram of FIG. 23 and the retreat position farther from the transport belt than the transport position as shown in a lower diagram of FIG. 23. The driven roller 61 in the transport position is denoted by a solid line and the driven roller 61 in the retreat position is denoted by a dotted line in FIG. 22.

More specifically, the driven roller 61 is supported by the base portion 62 including the restrictor 60 to be described below. The base portion 62 swings about the pivot shaft 60*a* and the driven roller 61 moves between the transport position and the retreat position.

Then, the driven roller 61 is in the retreat position when a single sheet of the medium P is transported in the transport belt 40 and in the transport position when a plurality of sheets of medium P are transported in the transport belt 40 as shown in FIG. 22.

Figure 4:
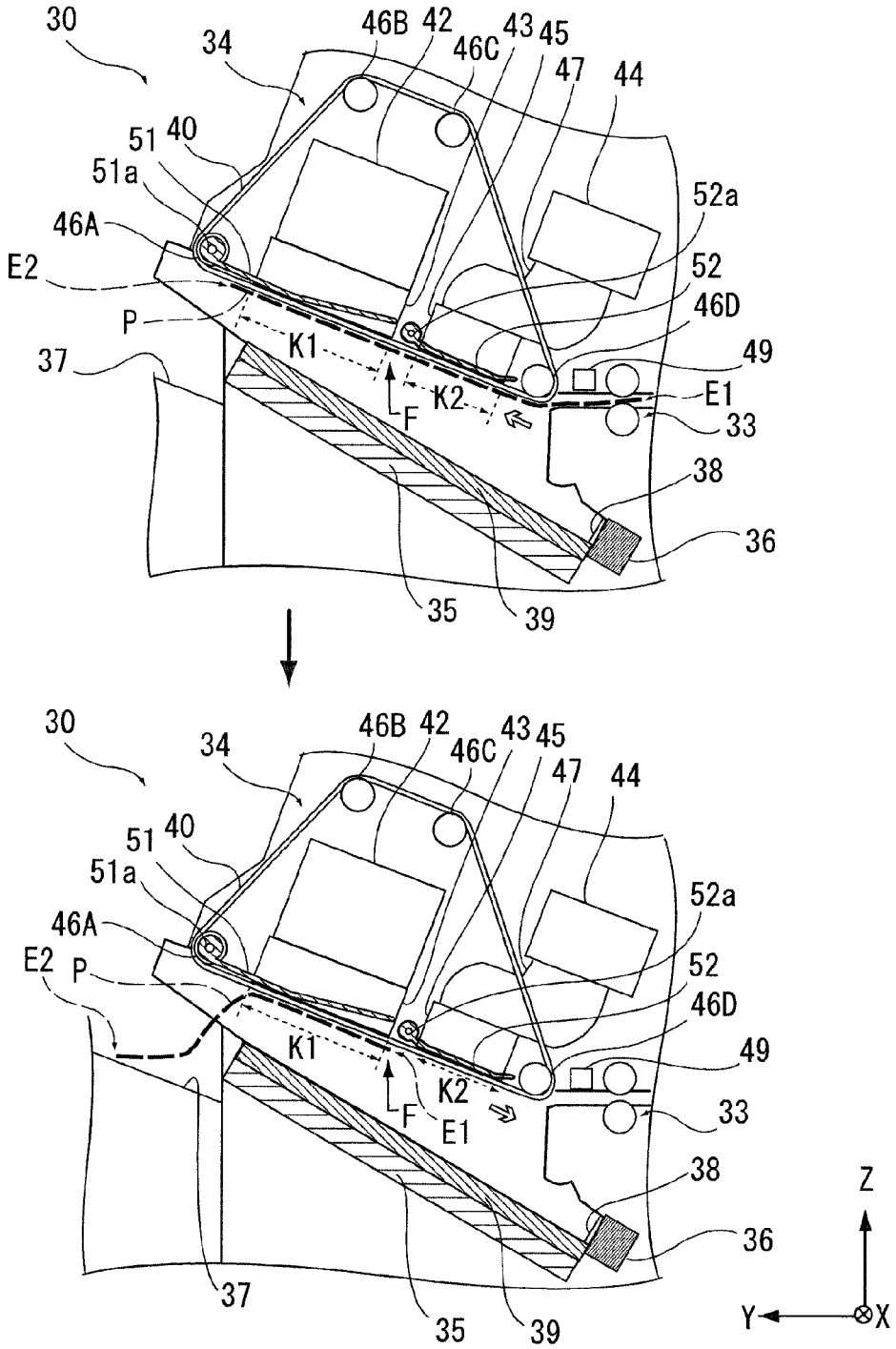
FIG. 4 is a view describing transport of a medium in a processing unit.

For example, as shown in an upper diagram of FIG. 4, since the medium P is adsorbed on the transport surface 40*a* when a single sheet of medium P is transported, the driven roller 61 is in the retreat position, and it is possible to transport only by the adsorption force in the transport belt 40.

On the other hand, since the driven roller 61 is in the transport position when a plurality of sheets of medium P are transported in the transport belt 40 as shown in FIG. 22, it is possible to transport the overlapping preceding medium P1 and the succeeding medium P2 nipped between the driven roller 61 and the transport belt 40. Therefore, it is possible to transport, and appropriately place in the first tray 35, the preceding medium P1 and the succeeding medium P2 in an overlapping state even if the preceding medium P1 positioned below is not adsorbed on the transport surface 40*a*.

Further, as shown in FIG. 22, when a first driven roller 63 configured to rotate by the movement of the transport belt 40 is provided inside the ring of the transport belt 40 and the driven roller 61 is in the transport position, the transport belt 40 is nipped between the driven roller 61 and the first driven roller 63. In this way, it is possible to suppress an increase in a driving load of the transport belt 40 when the driven roller 61 is in the transport position.

On Guider

Next, a guider 80 provided in the −Y direction of the driven roller 61 will be described.

The guider 80 is configured to switch between a first state shown in a lower diagram of FIG. 23 and a second state shown in an upper diagram of FIG. 23, and the guider 80 switching from the second state to the first state along with the movement of the driven roller 61 from the retreat position (the upper diagram of FIG. 23) to the transport position (lower diagram of FIG. 23) is provided.

The guider 80 in the first state shown in the lower diagram of FIG. 23 is in a state of guiding a medium in a direction between the driven roller 61 in the transport position and the transport belt 40. The guider 80 in the second state shown in the upper diagram of FIG. 23 is along the placement surface of the first tray 35.

The guider 80 is also shown in FIGS. 12 to 15. FIGS. 12 and 13 show the second state of the guider 80 and FIGS. 14 and 15 show the first state of the guider 80.

Figure 24:
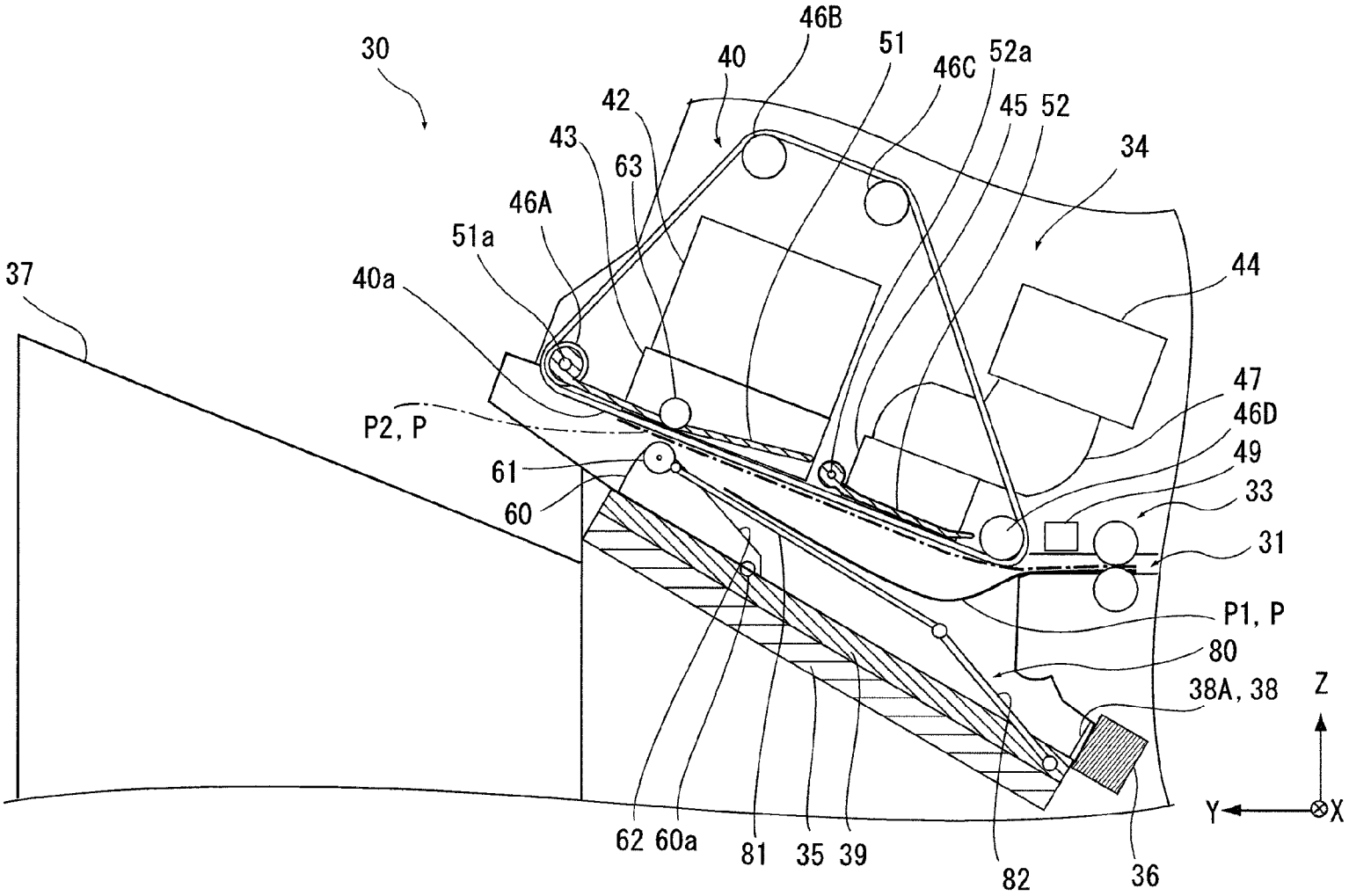
FIG. 24 is a schematic view describing the first state of the guider.

If the guider 80 is in the first state, as shown in FIG. 24, the preceding medium P1 is transported by a second transport roller pair 33, advancing along the guider 80 even when, out of two sheets of media P of the overlapping preceding medium P1 and the succeeding medium P2, the preceding medium P1 below is not adsorbed on the transport surface 40*a* to hang down. In this way, it is possible to guide and nip the leading end in the first transport direction +Y of the preceding medium P1 between the driven roller 61 in the transport position and the transport belt 40.

Since the guider 80 switches from the second state to the first state along with the movement of the driven roller 61 from the retreat position to the transport position, it is possible to bring the guider 80 into the first state when the driven roller 61 moves to the transport direction, that is, when a plurality of sheets of medium P are transported by the transport belt 40. Therefore, it is possible to guide the preceding medium P1 positioned below and not adsorbed on the transport surface 40*a*, out of a plurality of media P, between the driven roller 61 and the transport belt 40.

In the present embodiment, the guider 80 includes a first arm 91 which is positioned upstream of the driven roller 61 with respect to the first transport direction +Y and which constitutes the guider 80 and a second arm 92 which is positioned upstream of the first arm 91 with respect to the first transport direction +Y and which is connected with the first arm 91, and the first arm in the first state shown in the lower diagram of FIG. 23 configured to form a posture so as to shorten the distance between the surface facing the transport belt 40 and the transport belt 40 facing the driven roller 61.

On Transporter

Next, the transporter 34 transporting the medium by the transport belt 40 will be described in detail.

In the transporter 34 shown in FIG. 3, the transport belt 40 has the first adsorption area K1 as an "adsorption area" in which the medium is adsorbed on the transport surface 40*a* and is configured to transport the medium in the first transport direction +Y and the second transport direction −Y by adsorbing the medium in the adsorption area and rotating. The transport belt 40 is disposed above the medium P to be transported. That is, the transport belt 40 is configured to adsorb and transport the medium from above.

In the present embodiment, a second adsorption area K2 in which the medium is adsorbed is provided upstream of the first adsorption area K1 in the first transport direction +Y. It is possible to omit the second adsorption area K2 in the transporter 34.

Figure 2:
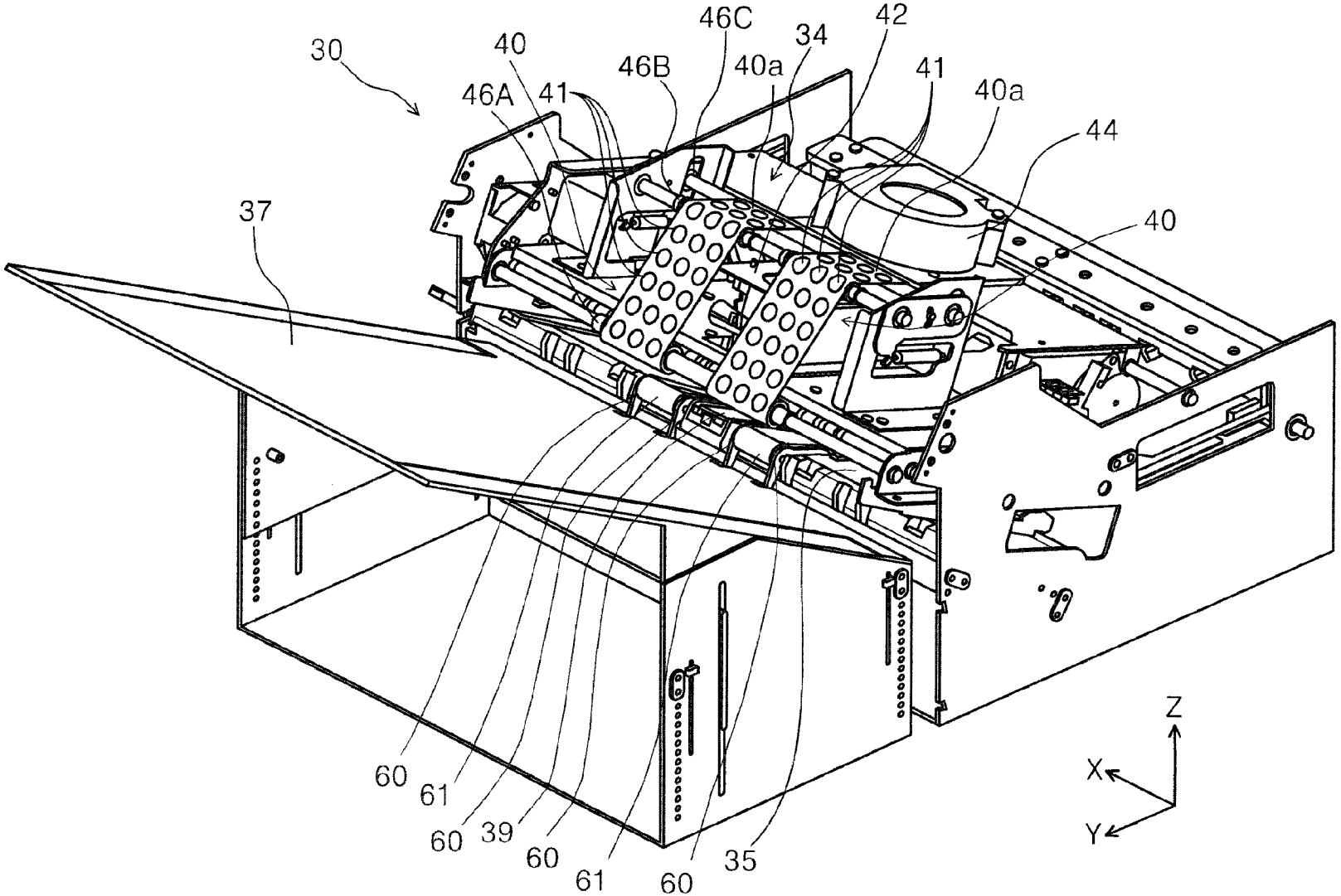
FIG. 2 is a perspective view showing a medium discharging device according to the first embodiment.

As shown in FIG. 2, two transport belts 40 are provided at an interval in the X-axis direction which is a width direction intersecting with the first transport direction +Y.

As shown in FIG. 3, the annular transport belt 40 is wound around four rollers of a first roller 46A, a second roller 46B, a third roller 46C, and a fourth roller 46D. The fourth roller 46D is configured to rotate clockwise and counterclockwise in FIG. 3 by the power of a drive source (not shown).

The transport belt 40 adsorbs the medium in the first adsorption area K1 and the second adsorption area K2 positioned between the first roller 46A and the fourth roller 46D.

In FIG. 3, if the fourth roller 46D rotates clockwise, the transport belt 40 also rotates clockwise and the medium adsorbed by the transport belt 40 is transported in the first transport direction +Y. Conversely, if the fourth roller 46D rotates counterclockwise, the transport belt 40 also rotates counterclockwise and the medium adsorbed by the transport belt 40 is transported in the second transport direction −Y. The third roller 46C is configured to move in a direction along a long hole 48 shown in FIG. 3 and to adjust the tension of the transport belt 40.

The transporter 34 has a plurality of holes 41 as shown in FIG. 2 and includes the annular transport belt 40 driven to rotate and a first suction unit 43 provided inside the ring of the transport belt 40 as shown in FIG. 3. The first suction unit 43 generates an adsorption force in a part of the plurality of holes 41 subjected to a negative pressure by the first sucker 42. A suction pump or a suction fan can be used as the first sucker 42.

More specifically, in the first suction unit 43 shown in FIG. 3, the internal space is subjected to the negative pressure by the suction of the first sucker 42. A lower portion of the first suction unit 43 facing the transport belt 40 is opened and a suction force is generated in the holes 41 of the transport belt 40 passing below the first suction unit 43 subjected to the negative pressure. The adsorption area corresponding to the first suction unit 43 is the first adsorption area K1.

Figure 7:
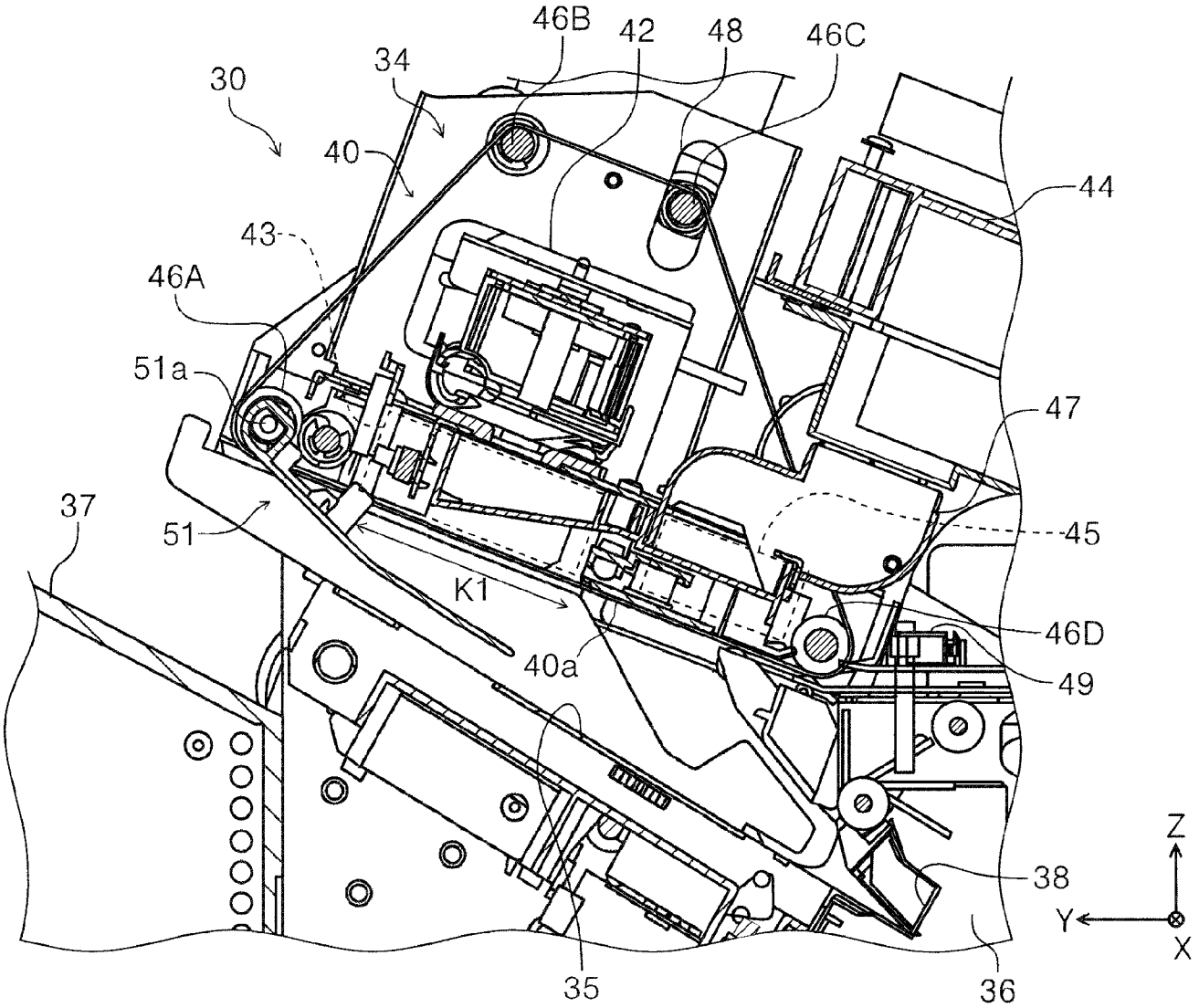
FIG. 7 is a side sectional view showing a protruding state of a first peeling unit.

A first peeler 51 shown in FIG. 3 is provided in a position corresponding to the first suction area K1 in the second transport direction −Y. The first peeler 51 is configured to switch between a protrusion state where the first peeler 51 protrudes from the transport surface 40*a* of the transport belt 40 as shown in FIG. 7 and a retreat state where the first peeler 51 does not protrude from the transport surface 40*a* as shown in FIG. 3. By switching from the retreat state shown in FIG. 3 to the protrusion state shown in FIG. 7, the first peeler 51 peels the medium P from the transport belt 40.

Further, a second suction unit 45, in which an adsorption force is generated in a part of the plurality of holes 41 subjected to negative pressure by a second sucker 44, is provided upstream in the first transport direction +Y of the first suction unit 43 in FIG. 3. If a switching position F shown in a lower diagram of FIG. 4 to be described below is set to be a reference, the second suction unit 45 is disposed between the second transport roller pair 33 in the first transport direction +Y and the switching position F inside the ring of the transport belt 40.

The second sucker 44 sucks the air inside the second suction unit 45 through a conduit 47 to subject the inside of the second suction unit 45 to negative pressure. A suction pump or a suction fan can be used as the second sucker 44. The adsorption area corresponding to the second suction unit 45 is the second adsorption area K2.

As described with reference to FIGS. 4 and 5, the transport belt 40 is configured to adsorb the medium P delivered from the second transport roller pair 33 on the transport belt 40 to transport the medium P in the first transport direction +Y such that the first end portion E1 of the medium is transported to the predetermined switching position F and the medium P is transported in the second transport direction −Y to be placed in the first tray 35.

In the following, the transport of the medium P to the first tray 35 by the transporter 34 will be described with reference to FIGS. 4 and 5.

The medium P transported in the first transport direction +Y by the second transport roller pair 33 is adsorbed on the transport belt 40 by the adsorption force in the first adsorption area K1 and the second adsorption area K2 and is transported in the first transport direction +Y, as shown in the upper diagram of FIG. 4. The white arrow indicates the moving direction of the transport belt 40 in the upper diagram of FIG. 4. That is, the transport belt 40 rotates clockwise in a plan view of the upper diagram of FIG. 4.

If the medium P is further transported from the state of the upper diagram of FIG. 4 and the first end portion E1 of the medium P reaches the switching position F as shown in the lower diagram of FIG. 4, the rotation of the transport belt 40 is reversed and the medium P is transported in the second transport direction −Y. That is, the transport belt 40 is rotated counterclockwise in the plan view of the lower diagram of FIG. 4.

In the present embodiment, a medium detector 49 is provided between the transporter 34 and the second transport roller pair 33, and it is possible to determine the switching timing of the rotation direction of the transport belt 40 based on the detection of the medium P in the medium detector 49.

For example, the transport belt 40 is rotated clockwise by as much as a predetermined driving amount after the medium detector 49 detects the first end portion E1 of the medium P transported in the first transport direction +Y, and the transport belt 40 is rotated counterclockwise once the first end portion E1 is transported to the switching position F.

Further, the medium detector may be provided in the switching position F and the rotation direction of the transport belt 40 may be switched at the detection timing of the first end portion E1 in the switching position F.

A second peeler 52 peeling from the transport belt 40 the medium P adsorbed in the second adsorption area K2 of the transport belt 40 is provided in the transporter 34. The second peeler 52 has a pivot shaft 52*a* upstream in the second transport direction −Y with respect to the second adsorption area K2 and swings with a downstream end as a free end. The second peeler 52 is positioned inside the rim of the transport belt 40 as shown in the upper diagram of FIG. 4 when the medium P is adsorbed in the second adsorption area K2 and swings to protrude outside the rim of the transport belt 40 as shown in an upper diagram of FIG. 5 when the medium P adsorbed in the second adsorption area K2 is peeled from the transport belt 40.

Figure 6:
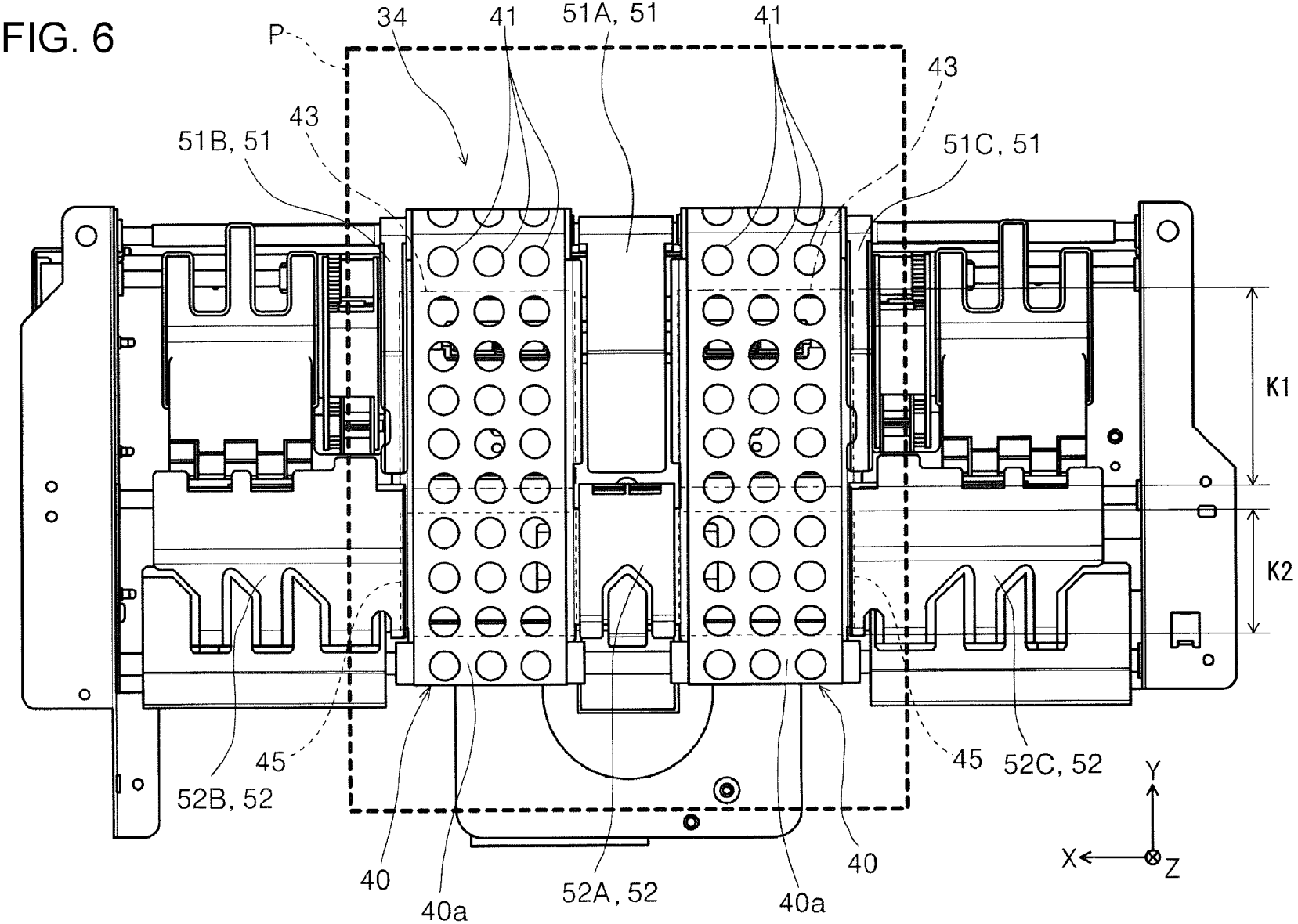
FIG. 6 is a bottom surface view showing a main portion of a medium transporting device.

As shown in FIG. 6, the second peeler 52 includes a second peeler 52A provided between the two transport belts 40 which is the width direction and a second peeler 52B and a second peeler 52C provided on two sides of the two transport belts 40 in the X-axis direction. That is, a plurality of the second peelers 52 are provided in the X-axis direction which is the width direction intersecting with the second transport direction −Y.

After the first end portion E1 of the medium P transported in the first transport direction +Y is positioned in the switching position F, the second peeler 52 is made to protrude outside the rim of the transport belt 40 before the transport direction of the medium P is switched from the first transport direction +Y to the second transport direction −Y.

In this way, it is possible to guide the medium P toward the first tray 35 positioned below the transport belt 40 while suppressing a re-adsorption of the medium P in the second adsorption area K2 when the medium P is transported in the second transport direction −Y.

Further, the transporter 34 includes the first peeler 51 in a position corresponding to the first adsorption area K1 described above.

Figure 5:
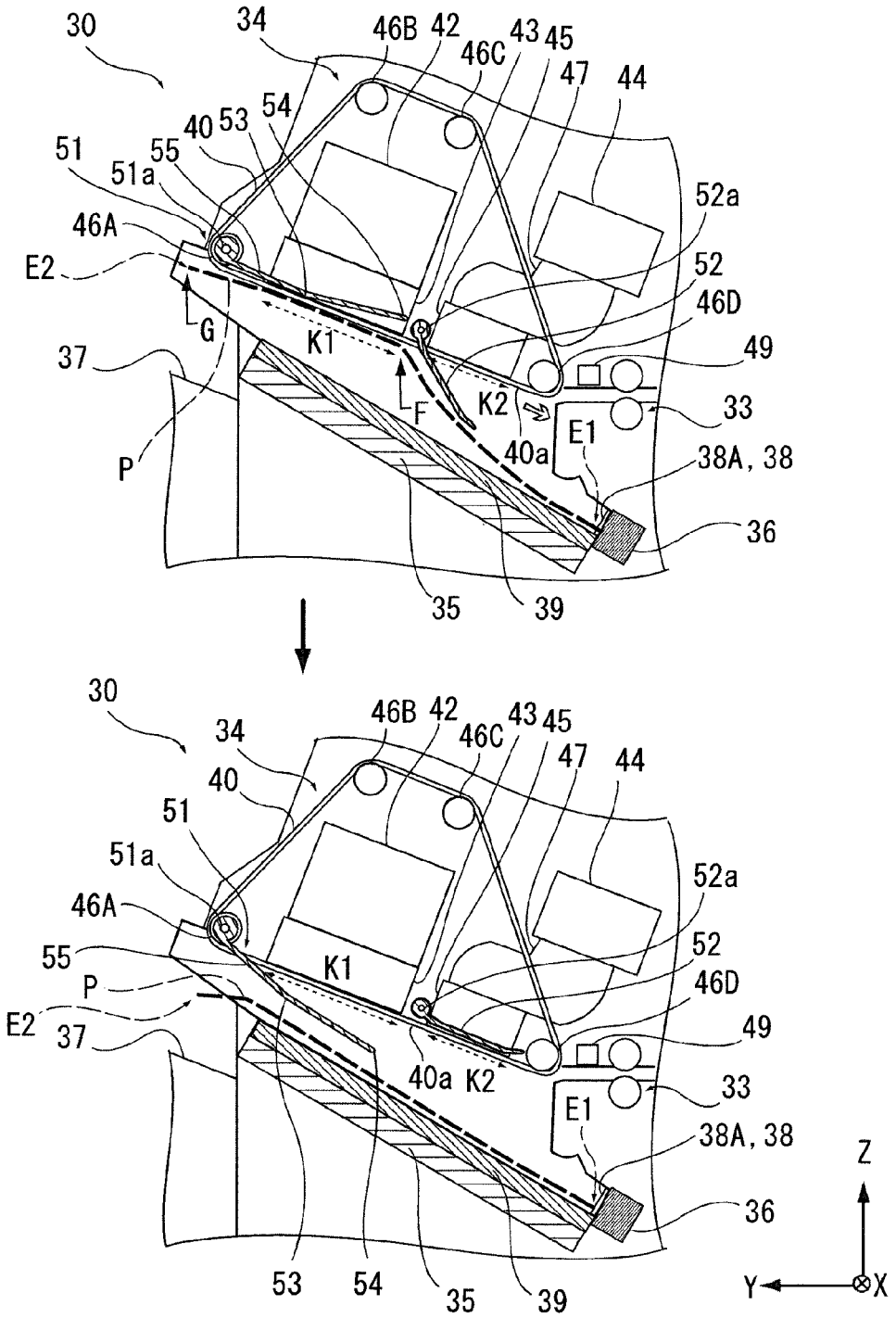
FIG. 5 is a view describing transport of a medium in the processing unit.

If the medium P is fed by the transport belt 40 in the second transport direction −Y, the first end portion E1 of the medium P is positioned in the aligner 38 of the first tray 35 as shown in the upper diagram of FIG. 5, the rotation of the transport belt 40 is stopped, the first peeler 51 is switched from the retreat position to the protrusion state shown in a lower diagram of FIG. 5, and the medium P is peeled from the first adsorption area K1. Therefore, it is possible to place the medium P in the first tray 35 in a state where the first end portion E1 of the medium P is straightened in the predetermined position.

It is possible to determine that the first end portion E1 of the medium P is transported to the position of the aligner 38 and stop the rotation of the transport belt 40 when predetermined time elapses after the transport direction of the medium P is switched from the first transport direction +Y to the second transport direction −Y. Further, it is possible to provide a detector configured to detect the first end portion E1 in the position of the aligner 38 and stop the rotation of the transport belt 40 at the time when the detector detects the first end portion E1.

As the first peeler 51 is brought into the protrusion state, the second peeler 52 retreats to the transport surface 40*a* side as shown in a lower diagram of FIG. 5 and it is possible to adsorb the medium P in the second adsorption area K2.

Therefore, if the medium transported earlier is taken as a preceding medium P1, it is possible to receive and adsorb the succeeding medium P2 successively transported in the second adsorption area K2 while peeling the preceding medium P1 from the transport belt 40 by the first peeler 51 and placing the medium P1 in the first tray 35.

When the succeeding medium P2 is transported following the preceding medium P1, the first peeler 51 is configured to be displaced from the retreat state shown in the upper diagram of FIG. 5 to the protrusion state shown in the lower diagram of FIG. 5, press the preceding medium P1 placed in the first tray 35, maintaining the protrusion state, after the preceding medium P1 is peeled from the transport belt 40, and be displaced to the retreat position before the succeeding medium P2 reaches the first adsorption area K1, when the succeeding medium P2 is transported following the preceding medium P1. In this way, it is possible to alleviate the concern that the preceding medium P1 placed in the first tray 35 floats up and is adsorbed again on the transport belt 40 by the time the succeeding medium P2 reaches the first adsorption area K1.

It is possible to set the timing of the first peeler 51 in the protrusion state in the lower diagram of FIG. 5 returning to the retreat state after an elapse of a predetermined time from the detection of the succeeding medium P2 by the medium detector 49, for example. It is possible to set the predetermined time within a range where the succeeding medium P2 transported in the first transport direction +Y does not reach the first adsorption area K1 after the succeeding medium P2 is detected by the medium detector 49.

Further, for example, it is possible to provide a medium detector separate from the medium detector 49 downstream of the medium detector 49 in the first transport direction +Y and upstream of the first adsorption area K1 and bring the first peeler 51 into the retreat state at the time when the medium detector detects the succeeding medium P2.

It is desirable that the first peeler 51 is in the protrusion state until immediately before the succeeding medium P2 reaches the first adsorption area K1. In this way, it is possible to further alleviate the concern of re-adsorption of the preceding medium P1 on the transport belt 40.

The first peeler 51 and the second peeler 52 swing by the power of a driving source (not shown). It is possible to drive the first peeler 51 and the second peeler 52 by a common driving source. It is needless to say that the peelers may be driven by separate driving sources.

Further, in the present embodiment, the transport belt 40 is of a suction and adsorption type, but it is also possible to use a transport belt of an electrostatic adsorption type, for example.

Further, the adsorption area in the transport belt 40 can be made of only the first adsorption area K1, the second adsorption area K2 being omitted, and it is possible to configure the transport belt 40 with three or more adsorption areas to which adsorption force is imparted by individual suckers and suction units.

In the present embodiment, it is possible to regard the processing unit 4 as a "medium processing device" including the medium discharging device 30 and the processor 36 executing predetermined processing on the medium placed in the first tray 35. Further, it is possible to regard the recording system 1 as a "medium processing device" including the medium discharging device 30 and the processor 36 executing predetermined processing on the medium placed in the first tray 35. Further, it is also possible to regard the recording system 1 minus the recording function as a "medium discharge device". Alternatively, from the viewpoint of the medium discharging, it is possible to regard the recording system 1 itself as a recording discharging device even if the recording function is included.

Further, it is needless to say that the present disclosure is not limited to the above embodiment, that various modifications are possible within the scope of the disclosure described in the claims, and that the modifications are also included within the scope of the present disclosure.

What is claimed is:

1. A medium discharging device comprising:

a first tray receiving a medium;

a second tray receiving the medium discharged from the first tray;

a supporter which is configured to be displaced in a first direction between a retreat position in the first tray and an advance position above the second tray, and the advance position is ahead of the retreat position in a discharge direction from the first tray to the second tray, and the supporter supports the medium, an aligner which is provided in the supporter and is displaced together with the supporter and the aligner aligns an upstream end portion of the medium supported by the supporter; and a restrictor configured to be displaced in a second direction that intersects the first direction between a restriction position where an upstream movement of the end portion of the medium in a position of the aligner in the discharge direction is restricted and a non-restriction position where the movement is not restricted, when the supporter is in the advance position, the restrictor being provided at a downstream end of the first tray in the discharge direction, wherein the supporter is configured to change a length along with displacement from the retreat position to the advance position, wherein the supporter includes a first member which is configured to slide with respect to the first tray in the discharge direction and which has a first rack portion and a second rack portion provided in the discharge direction, a second member which is configured to slide with respect to the first member in the discharge direction and which has a third rack portion provided in the discharge direction, a third member which is configured to slide with respect to the first member in the discharge direction and which has a fourth rack portion provided to face the second rack portion in a width direction intersecting with the discharge direction, a first gear engaging with the first rack portion, a second gear having a larger number of teeth formed on a rim than the first gear and engaging with the third rack portion to integrally rotate with the first gear, and a pinion gear having a rotation shaft in the second member and engaging with both the second rack portion and the fourth rack portion.

2. The medium discharging device according to claim 1, wherein the restrictor is displaced to the restriction position after the aligner is displaced downstream of a position of the restrictor in the discharge direction and is displaced to the non-restriction position after the aligner is displaced to the retreat position.

3. The medium discharging device according to claim 1, wherein the aligner is provided upstream of the third member in the discharge direction.

4. The medium discharging device according to claim 1, wherein the pinion gear is configured to move downstream of the first tray in the discharge direction.

5. The medium discharging device according to claim 1, further comprising:

a transport belt positioned above the first tray and configured to transport the medium by rotating with the medium adsorbed on a transport surface, wherein the restrictor includes a driven roller transporting the medium together with the transport belt when the restrictor is in the restriction position.

6. The medium discharging device according to claim 1, wherein the restrictor is configured to swing about a pivot shaft to be displaced between the restriction position and the non-restriction position.

7. The medium discharging device according to claim 1, wherein the restriction position is the position where the restrictor is above a placement surface of the first tray, the non-restriction position is the position where the restrictor is under the placement surface of the first tray, the restrictor is configured to be displaced from the non-restriction position to the restriction position at a downstream end of the first tray in the discharge direction.

8. A medium discharging device comprising:

a first tray receiving a medium;

a second tray receiving the medium discharged from the first tray;

a supporter which is configured to be displaced in a first direction between a retreat position in the first tray and an advance position above the second tray, and the advance position is ahead of the retreat position in a discharge direction from the first tray to the second tray, and the supporter supports the medium, an aligner which is provided in the supporter and is displaced together with the supporter and the aligner aligns an upstream end portion of the medium supported by the supporter; and a restrictor configured to be displaced in a second direction that intersects the first direction between a restriction position where an upstream movement of the end portion of the medium in a position of the aligner in the discharge direction is restricted and a non-restriction position where the movement is not restricted, when the supporter is in the advance position, the restrictor being provided at a downstream end of the first tray in the discharge direction, wherein the restriction position is the position where the restrictor protrudes from a placement surface of the first tray, wherein the supporter includes a first member which is configured to slide with respect to the first tray in the discharge direction and which has a first rack portion and a second rack portion provided in the discharge direction, a second member which is configured to slide with respect to the first member in the discharge direction and which has a third rack portion provided in the discharge direction, a third member which is configured to slide with respect to the first member in the discharge direction and which has a fourth rack portion provided to face the second rack portion in a width direction intersecting with the discharge direction, a first gear engaging with the first rack portion, a second gear having a larger number of teeth formed on a rim than the first gear and engaging with the third rack portion to integrally rotate with the first gear, and a pinion gear having a rotation shaft in the second member and engaging with both the second rack portion and the fourth rack portion.

9. The medium discharging device according to claim 8, wherein the restrictor is configured to swing about a pivot shaft to be displaced between the restriction position and the non-restriction position.

10. A medium discharging device comprising:

a first tray receiving a medium;

a second tray receiving the medium discharged from the first tray;

a supporter which is configured to be linearly displaced between a retreat position in the first tray and an advance position above the second tray, and the advance position is ahead of the retreat position in a discharge direction from the first tray to the second tray, and the supporter supports the medium, an aligner which is provided in the supporter and is displaced together with the supporter and the aligner aligns an upstream end portion of the medium supported by the supporter; and a restrictor configured to be displaced between a restriction position where an upstream movement of the end portion of the medium in a position of the aligner in the discharge direction is restricted and a non-restriction position where the movement is not restricted, when the supporter is in the advance position, wherein the supporter is configured to move to the advance position while supporting the entire medium until the upstream end portion of the medium aligned by the aligner is above the second tray, and the restrictor is at a downstream end of the first tray in the discharge direction.

11. The medium discharging device according to claim 10, wherein the supporter includes a first member which is configured to slide with respect to the first tray in the discharge direction and which has a first rack portion and a second rack portion provided in the discharge direction, a second member which is configured to slide with respect to the first member in the discharge direction and which has a third rack portion provided in the discharge direction, a third member which is configured to slide with respect to the first member in the discharge direction and which has a fourth rack portion provided to face the second rack portion in a width direction intersecting with the discharge direction, a first gear engaging with the first rack portion, a second gear having a larger number of teeth formed on a rim than the first gear and engaging with the third rack portion to integrally rotate with the first gear, and a pinion gear having a rotation shaft in the second member and engaging with both the second rack portion and the fourth rack portion.

12. The medium discharging device according to claim 11, wherein the aligner is provided upstream of the third member in the discharge direction.

13. The medium discharging device according to claim 11, wherein the pinion gear is configured to move downstream of the first tray in the discharge direction.

14. The medium discharging device according to claim 10, further comprising:

a transport belt positioned above the first tray and configured to transport the medium by rotating with the medium adsorbed on a transport surface, wherein the restrictor includes a driven roller transporting the medium together with the transport belt when the restrictor is in the restriction position.

15. The medium discharging device according to claim 10, wherein the restrictor is configured to swing about a pivot shaft to be displaced between the restriction position and the non-restriction position.

16. A medium processing device comprising:

the medium discharging device according to claim 10; and a processor executing predetermined processing on the medium placed in the first tray.

17. A recording system comprising:

a recording unit including a recorder performing recording on a medium; and a processing unit discharging the medium after recording in the recording unit, including the medium discharging device according to claim 10, and including a processor executing predetermined processing on the medium placed in the first tray.

18. The recording system according to claim 17, further comprising:

an intermediate unit receiving the medium after recording from the recording unit and delivering the medium to the processing unit.

* * * * *